US006412460B1

(12) United States Patent
Sato et al.

(10) Patent No.: US 6,412,460 B1
(45) Date of Patent: Jul. 2, 2002

(54) VALVE OPERATING SYSTEM IN INTERNAL COMBUSTION ENGINE

(75) Inventors: Toshiyuki Sato; Toshihiro Oikawa; Toshihiro Kamiyama; Mamoru Kosuge; Yutaka Otobe, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/466,831

(22) Filed: Dec. 20, 1999

Related U.S. Application Data

(60) Continuation-in-part of application No. 09/420,409, filed on Oct. 19, 1999, now Pat. No. 6,125,805, which is a division of application No. 09/102,630, filed on Jun. 23, 1998, now Pat. No. 5,979,379.

(30) Foreign Application Priority Data

| | | |
|---|---|---|
| Jun. 24, 1997 | (JP) | 9-167235 |
| Jun. 25, 1997 | (JP) | 9-168304 |
| Jun. 27, 1997 | (JP) | 9-171852 |
| Dec. 22, 1998 | (JP) | 10-364380 |
| Dec. 23, 1998 | (JP) | 10-376345 |
| Dec. 10, 1999 | (JP) | 11-351800 |

(51) Int. Cl.[7] ..... F01L 13/00; F01L 1/18

(52) U.S. Cl. ..... 123/90.16; 123/90.27; 123/90.39; 123/90.42

(58) Field of Search ..... 123/90.15, 90.16, 123/90.17, 90.39, 90.4, 90.41, 90.42, 90.44; 74/519, 559

(56) References Cited

U.S. PATENT DOCUMENTS

| | | | | |
|---|---|---|---|---|
| 4,727,832 A | * | 3/1988 | Miyamura et al. | 123/90.44 |
| 4,841,922 A | * | 6/1989 | Taniguchi et al. | 123/90.51 |
| 5,456,225 A | | 10/1995 | Oikawa et al. | 123/90.16 |
| 5,460,130 A | | 10/1995 | Fukuzawa et al. | 123/90.16 |
| 5,515,820 A | | 5/1996 | Sugimoto et al. | 123/90.16 |
| 5,613,469 A | * | 3/1997 | Rygiel | 123/90.16 |
| 5,622,145 A | * | 4/1997 | Hara | 123/90.16 |
| 5,651,336 A | | 7/1997 | Rygiel et al. | 123/90.16 |
| 5,669,342 A | * | 9/1997 | Speil | 123/90.16 |
| 5,816,207 A | * | 10/1998 | Kadokawa et al. | 123/90.42 |

FOREIGN PATENT DOCUMENTS

| | | |
|---|---|---|
| DE | 44 33 457 A1 | 3/1996 |
| DE | 196 40 520 A1 | 4/1998 |
| EP | 0 267 696 A1 | 5/1988 |
| EP | 0 275 714 A1 | 7/1988 |
| EP | 0 364 069 A1 | 4/1990 |
| EP | 0 826 867 A1 | 3/1998 |
| EP | 0 887 519 A1 | 12/1998 |
| JP | 63-230916 | 9/1988 |
| JP | 2-50286 | 11/1990 |

OTHER PUBLICATIONS

Patent Abstracts of Japan, vol. 018, No. 491 (M–1672), Sep. 13, 1994 & JP 06 159018 A.

* cited by examiner

*Primary Examiner*—Weilun Lo
(74) *Attorney, Agent, or Firm*—Arent Fox Kintner Plotkin & Kahn, PLLC

(57) ABSTRACT

A valve operating system in an internal combustion engine includes a cam shaft provided with a valve operating cam, a rocker arm having a pair of support wall portions which are integrally connected at their base ends to a swinging support portion swingably supported on a support member mounted on a cylinder head and which are opposed to each other at a distance in a direction along the swinging axis of the swinging support portion, a support shaft supported between the support wall portions, and a roller which is rotatably supported on the support shaft with a bearing interposed therebetween so as to be in rolling contact with the valve operating cam. A lower connecting wall interconnecting lower portions of the base ends of the support wall portions is projectingly provided on the swinging support portion in a manner opposed to an outer peripheral surface of a lower portion of the roller. Thus, it is possible to increase the rigidity of the rocker arm, while avoiding an increase in size of the rocker arm.

18 Claims, 12 Drawing Sheets

VALVE OPERATING SYSTEM IN INTERNAL COMBUSTION ENGINE

This application is a continuation-in-part application filed under 37 CFR § 1.53(b) of parent application Ser. No. 09/420,409, filed Oct. 19, 1999 , now U.S. Pat. No. 6,125, 805, which is a divisional of Ser. No. 09/102,630, filed Jun. 23, 1998, now U.S. Pat. No. 5,979,379.

BACKGROUND OF THE INVENTION

1. Field of the Invention

The present invention relates to a valve operating system in an internal combustion engine, including a cam shaft provided with a valve operating cam, a rocker arm having a pair of support wall portions which are integrally connected at their base ends to a swinging support portion swingably supported on a support member mounted on a cylinder head, the support wall portions being opposed to each other at a distance in a direction along the swinging axis of the swinging support portion, a support shaft supported between the support wall portions, and a roller which is rotatably supported on the support shaft with a bearing interposed therebetween, the roller being in rolling contact with the valve operating cam.

2. Description of the Related Art

Such valve operating system is already known from Japanese Patent Application Laid-open No. 63-230916.

The rocker arm in the above known valve operating system is comprised of a swinging support portion swingably supported by a pivot serving as a support member, a pair of support wall portions connected at their base ends to the swinging support portion, and a tip-end connecting portion which connects tip ends of the support wall portions to each other. An engine valve is operatively connected to the tip-end connecting portion, and a roller is rotatably supported on a support shaft supported between the support wall portions to come into rolling contact with the valve operating cam. That face of the swinging support portion, which is opposed to the roller, is formed as a flat surface extending along a plane intersecting a straight line connecting a point at which the swinging support portion is swingably supported by the pivot, to the axis of rotation of the roller. It is difficult to say that the rigidity of the rocker arm of this system is excellent, and desirably the rigidity of the rocker arm should be increased. Moreover, it should be avoided that the size of the rocker arm is increased when its rigidity is increased.

SUMMARY OF THE INVENTION

Accordingly, it is an object of the present invention to provide a valve operating system in an internal combustion engine, wherein the rigidity of each of the rocker arms is increased, while avoiding an increase in size of the rocker arm.

To achieve the above object, according to a first aspect and feature of the present invention, there is provided a valve operating system in an internal combustion engine, comprising a cam shaft provided with a valve operating cam, a rocker arm having a pair of support wall portions which are integrally connected at base ends thereof to a swinging support portion swingably supported on a support member mounted on a cylinder head, the support wall portions being opposed to each other at a distance in a direction along a swinging axis of the swinging support portion, a support shaft supported between the support wall portions, and a roller which is rotatably supported on the support shaft with a bearing interposed therebetween, the roller being in rolling contact with the valve operating cam, wherein a lower connecting wall interconnecting lower portions of the base ends of the support wall portion is projectingly provided on the swinging support portion so as to be opposed to an outer peripheral surface of a lower portion of the roller.

With the arrangement of the first feature, the base ends of the pair of support wall portions are connected to each other by the lower connecting wall. Therefore, the rigidity of supporting the support shaft by the support wall portions is increased, and the rigidity of the entire rocker arm is also increased. The lower connecting wall is disposed while effectively utilizing space between the roller and the swinging support portions, and the size of the rocker arm is not increased due to the lower connecting wall.

According to a second aspect and feature of the present invention, in addition to the first feature, the lower connecting wall is located in proximity to and opposed to the outer peripheral surface of the lower portion of the roller to such an extent that oil can be once retained between the lower connecting walls and the rollers. With such arrangement, the oil can be once retained between the lower connecting wall and the roller, and the oil retained between the lower connecting wall and the roller can be guided to the bearing between the roller and the support shaft to reduce the resistance to the rotation of the roller.

According to a third aspect and feature of the present invention, in addition to the first feature, the rocker arm is formed from metal by injection molding. With the above feature, it is possible to simply form each of the rocker arms having a relatively complicated structure in which the lower connecting wall protrudes from the swinging support portion. Thus, it is possible to easily form the rocker arm to be of an optimal shape while taking an increase in rigidity and a reduction in weight into consideration.

According to a fourth aspect and feature of the present invention, in addition to the second feature, the valve operating system further includes an urging means for biasing the rocker arm in a direction to bring the roller into rolling contact with the valve operating cam, the urging means being put in abutment against a receiving portion which is projectingly provided at a lower portion of one of the support wall portions and connected to one end of the lower connecting wall in an axial direction of the support shaft. With such arrangement, the rigidity of the receiving portion receiving a load from the urging means can be increased by the lower connecting wall.

According to a fifth aspect and feature of the present invention, in addition to the third feature, the valve operating system further includes an urging means for biasing the rocker arm in a direction to bring the roller into rolling contact with the valve operating cam, the urging means being put in abutment against a receiving portion which is projectingly provided at a lower portion of one of the support wall portion and connected to one end of the lower connecting wall in an axial direction of the support shaft. With such arrangement, not only the rigidity of the receiving portion receiving a load from the urging means can be increased by the lower connecting wall, but also the rocker arm having the receiving portion integrally provided thereon can be formed easily.

According to a sixth aspect and feature of the present invention, in addition to the first feature, the support shaft is supported between the support wall portions with opposite ends of the support shaft being fitted in the support wall portions, at least one of the support wall portions having a receiving portion integrally provided thereon in a range corresponding to at least a portion of that area of the support shaft which is fitted into the one support wall portion, the receiving portion being disposed at a location radially outside the support shaft, and wherein an urging means is provided for exhibiting a spring force for urging the rocker arm in a direction to bring the roller, which is rotatably supported on the support shaft with the bearing interposed therebetween, into rolling contact with the valve operating cam, the urging means being put in abutment against the receiving portion.

With the arrangement of the sixth feature, it is possible to simplify the structure of the rocker arm in such a manner that the receiving portion is provided radially outside the roller. At the same time, the receiving portion does not protrude from the rocker arm in the axial direction of the support shaft. Therefore, it is possible to avoid an increase in size of the rocker arm in the axial direction of the support shaft, and the inertial weight is decreased. Therefore, it is possible to conveniently accommodate the high-speed rotation of the internal combustion engine. In addition, the rigidity of supporting the support shaft on the one support wall portion can be increased by the provision of the receiving portion.

According to a seventh aspect and feature of the present invention, in addition to the sixth feature, an oil passage is provided in the one support wall portion to extend along a plane which extends perpendicular to the axis of the support shaft and through an abutment point between the receiving portion and the urging means. With such arrangement, it is possible to compensate for a decrease in weight of the one support wall portion due to the provision of the oil passage which is a cavity, by the receiving portion, thereby improving the balance in weight between the support wall portions. Moreover, it is possible to avoid a reduction in rigidity of the one support wall portion due to the provision of the oil passage by providing the receiving portion.

According to an eighth aspect and feature of the present invention, in addition to the sixth feature, the rocker arm is formed from metal by injection molding. With such arrangement, a fitting bore for fitting the support shaft therein can be defined in the rocker arm simultaneously with the formation of the rocker arm, and the number of post-processings can be decreased to contribute to an enhancement in productivity.

According to a ninth aspect and feature of the present invention, in addition to the seventh feature, the rocker arm is formed from metal by injection molding. With such arrangement, even if the cross sectional shape of the oil passage is out of round, it is possible to define the oil passage simultaneously with the formation of the rocker arm, thereby providing an enhancement in productivity and increasing the degree of freedom in designing the cross sectional shape of the oil passage.

According to a tenth aspect and feature of the present invention, in addition to the first feature, a notch recessed on a side opposite to a spark plug insertion tube mounted in the cylinder head is provided in that portion of the swinging support portion of the rocker arm, which is opposed to the spark plug insertion tube, and at least a portion of the lower connecting wall and at least a portion of the notch are disposed in the same plane perpendicular to a swinging axis of the rocker arm. With such arrangement, the spark plug insertion tube and the rocker arm can be disposed in close proximity to each other to contribute to a reduction in weight of the rocker arm and a reduction in size of a valve operating chamber defined in the internal combustion engine in such a manner to accommodate the valve operating system in the engine. Moreover, it is possible to compensate for the reduction in rigidity of the swinging support portion due to the provision of the notch by the lower connecting wall.

The above and other objects, features and advantages of the invention will become apparent from the following description of the preferred embodiments taken in conjunction with the accompanying drawings.

BRIEF DESCRIPTION OF THE DRAWINGS

FIGS. 1 to 13 show a first embodiment of the present invention, wherein

FIG. 1 is a vertical sectional view taken along a line 1—1 in FIG. 2 and showing a portion of a valve operating system;

FIG. 2 is a plan view taken in a direction of an arrow 2 in FIG. 1;

FIG. 3 is a sectional view taken along a line 3—3 in FIG. 2;

FIG. 4 is a sectional view taken along a line 4—4 in FIG. 3;

FIG. 5 is an enlarged sectional view taken along a line 5—5 in FIG. 2;

FIG. 6 is a sectional view similar to FIG. 5, but in a state before caulking of a pin;

FIG. 7 is a sectional view taken along a line 7—7 in FIG. 2;

FIG. 8 is a sectional view taken along a line 8—8 in FIG. 4;

FIG. 9 is a sectional view taken along a line 9—9 in FIG. 2;

FIG. 10 is a sectional view taken along a line 10—10 in FIG. 4;

FIG. 11 is a sectional view taken along a line 11—11 in FIG. 10;

FIG. 12 is a plan view of intake-side and exhaust-side valve operating systems;

FIG. 13 is a sectional view taken along a line 13—13 in FIG. 12;

FIGS. 14 and 15 show a second embodiment of the present invention, wherein FIG. 14 is a sectional view of a free rocker arm; and FIG. 15 is a sectional view taken along a line 15—15 in FIG. 14.

DESCRIPTION OF THE PREFERRED EMBODIMENTS

Figure 1:
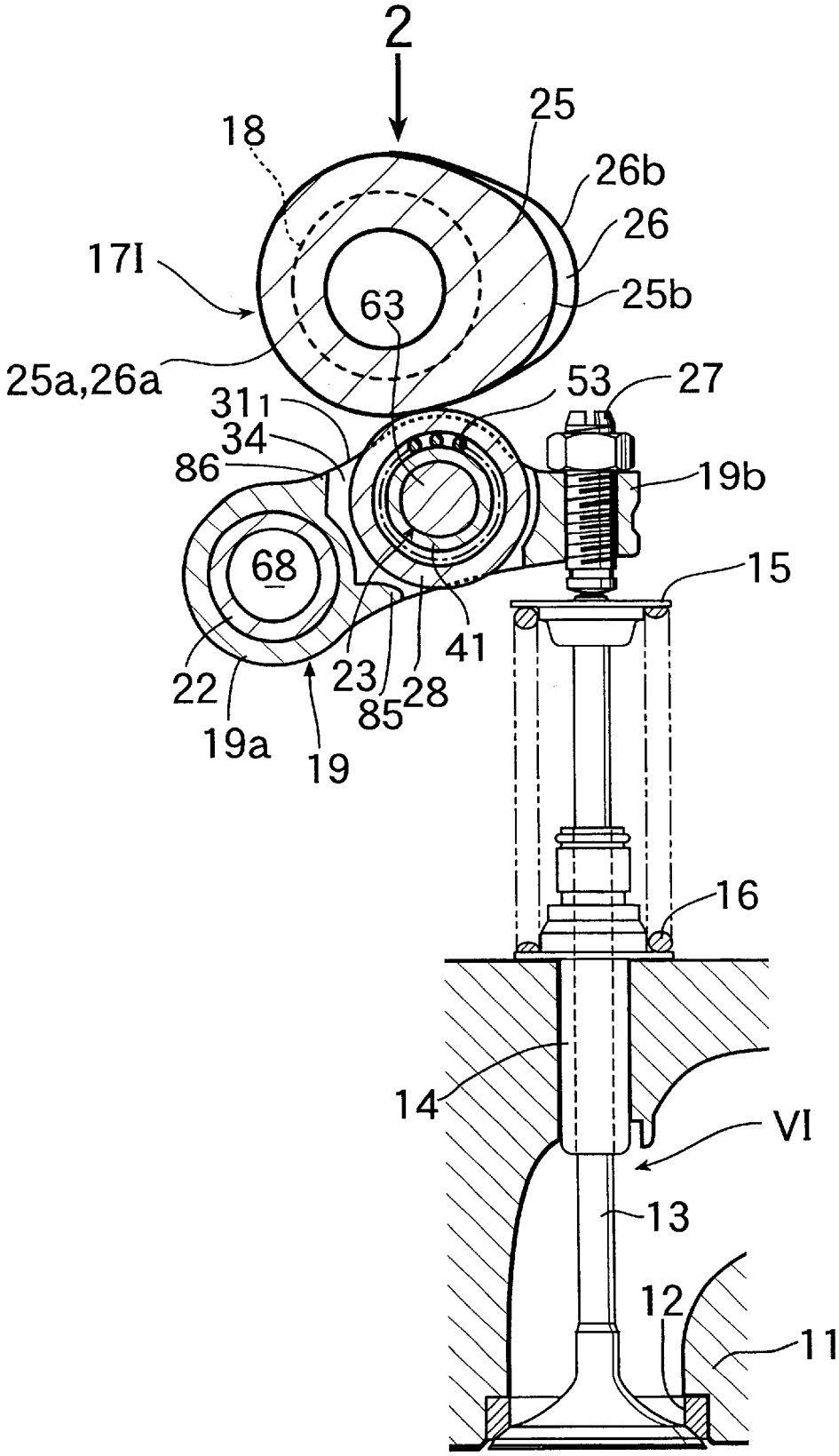

A first embodiment of the present invention will now be described with reference to FIGS. 1 to 13. Referring first to FIG. 1, a pair of intake valve bores 12 are provided for each of cylinders in a cylinder head 11 of a multi-cylinder, e.g., serial-4-cylinder internal combustion engine. The intake valve bores 12 are opened and closed individually by intake valves VI as engine valves, whose stems 13 are slidably fitted in guide tubes 14 provided in the cylinder head 11. Valve springs 16 are mounted between retainers 15 mounted at upper ends of the stems 13 protruding upwards from the guide tubes 14 and the cylinder head 11 to surround the stems 13, so that the intake valves VI are biased by the valve springs 16 in the direction to close the intake valve bores 12.

Figure 2:
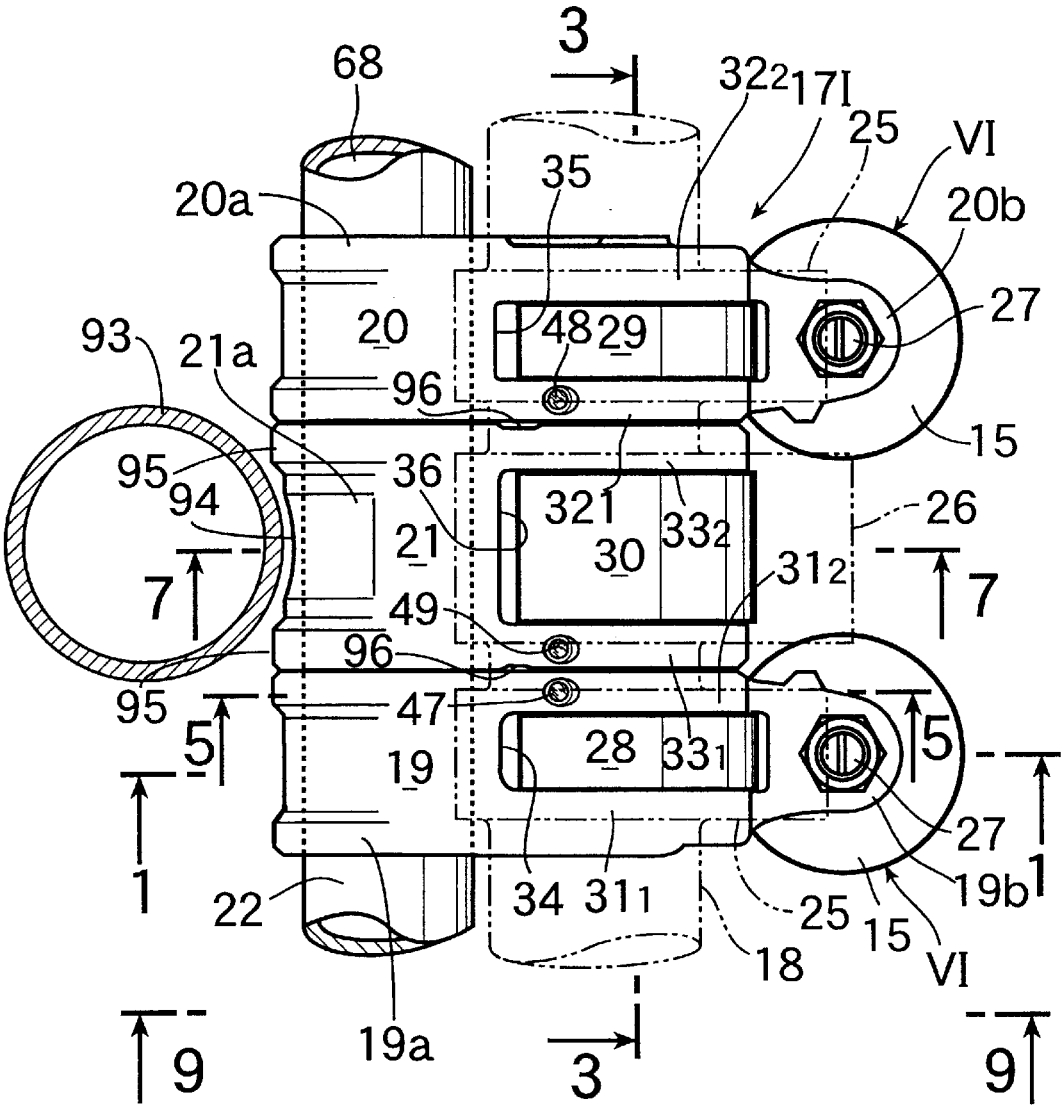
Figure 3:
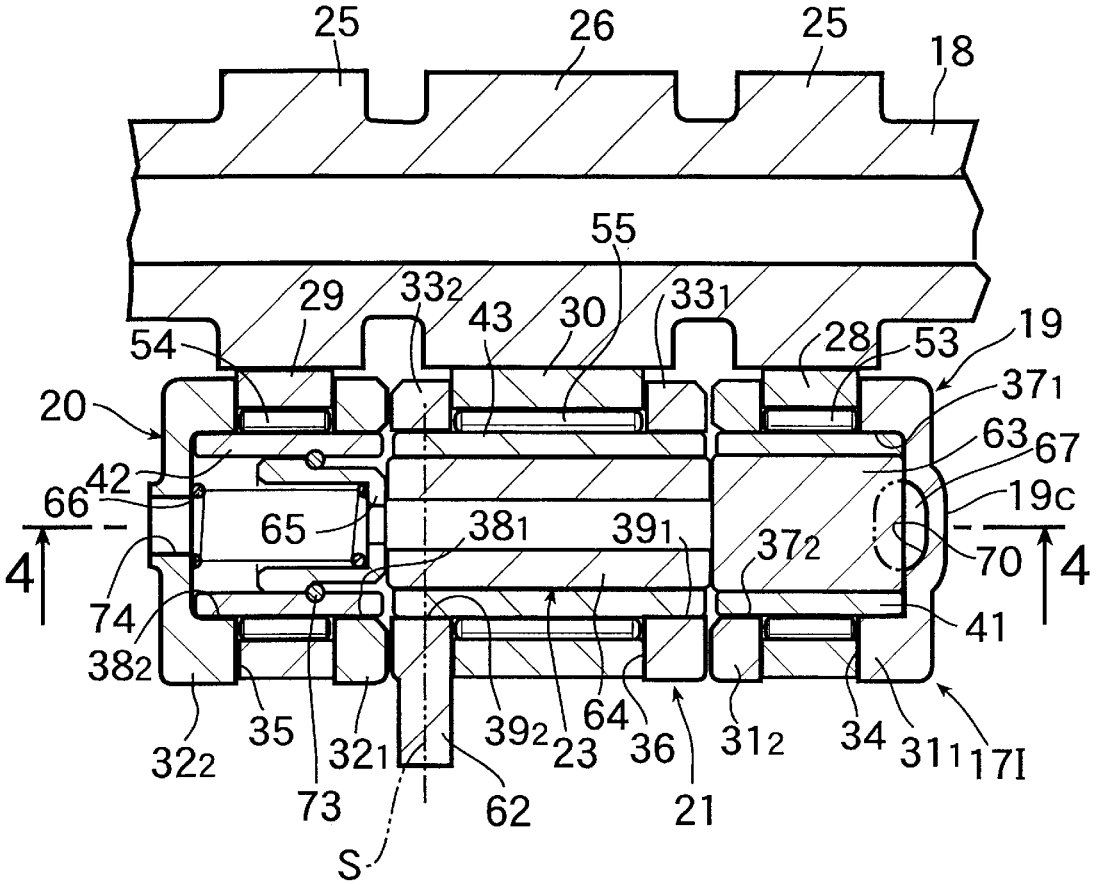
Figure 4:
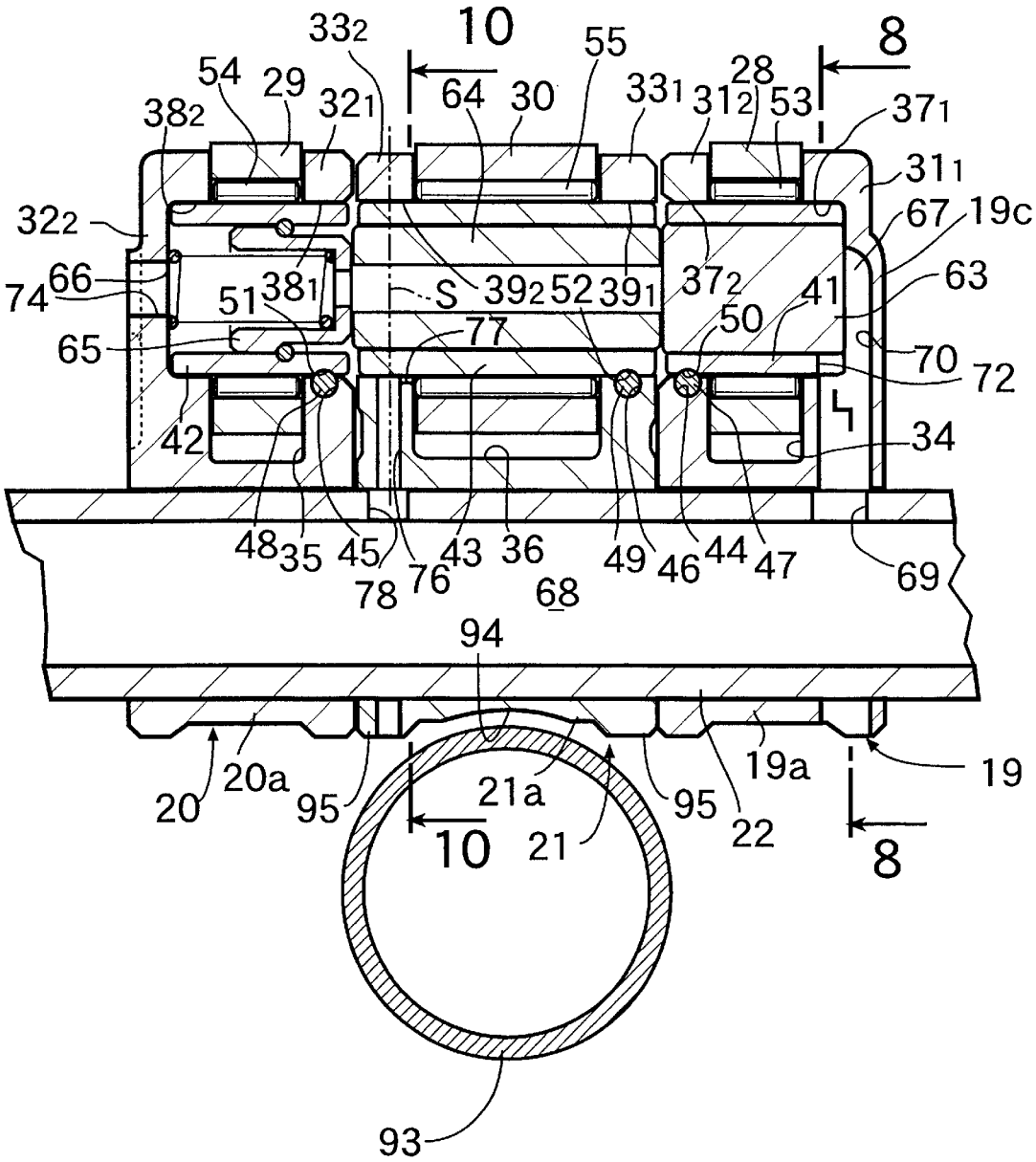

Referring also to FIGS. 2 to 4, an intake-side valve operating system 17I is connected to the pair of intake valves VI, VI, and includes a cam shaft 18 operatively connected to a crankshaft (not shown) at a reduction ratio of ½, a first driving rocker arm 19 operatively connected to one of the intake valves VI, a second driving rocker arm 20 operatively connected to the other intake valve VI, a free rocker arm 21 capable of becoming free relative to the intake valves VI, a stationary rocker shaft 22 as a support member for commonly supporting the rocker arms 19, 20 and 21 for swinging movement and having an axis parallel to the cam shaft 18, and an associative operation switching means 23 for switching the associative operation and the release of the associative operation of the rocker arms 19, 20 and 21.

Fixed to the cam shaft 18 are a high-speed valve operating cam 26 and low-speed valve operating cams 25, 25 which are disposed on opposite sides of the high-speed valve operating cam 26 in correspondence to the intake valves VI, respectively.

The high-speed valve operating cam 26 has a cam profile which enables the intake valves VI to be opened and closed in a high-speed operational range of the engine, and includes a base-circle portion 26*a* which is arcuate about an axis of the cam shaft 18, and a cam lobe 26*b* protruding radially outwards from the base-circle portion 26*a*. The low-speed valve operating cam 25 has a cam profile which enables the intake valves VI to be opened and closed in a low-speed operational range of the engine, and includes a base-circle portion 25*a* which is formed into an arcuate shape about the axis of the cam shaft 18, and a cam lobe 25*b* which protrudes radially outwards of the cam shaft 18 from the base-circle portion 25*a* over a range of center angle smaller than that of the cam lobe 26*b* and in an amount smaller than the amount of cam lobe 26*b* protruding from the base-circle portion 26*a* in the high-speed valve operating cam 26.

The first driving rocker arm 19, the second driving rocker arm 20 and the free rocker arm 21 are carried swingably and commonly on the rocker shaft 22 and disposed adjacent one another in such a manner that the free rocker arm 21 is sandwiched between the first and second driving rocker arms 19 and 20.

Each of the first and second driving rocker arms 19 and 20 is integrally provided with a swinging support portion 19*a*, 20*a* swingably supported on the rocker shaft 22, a first support wall portion $\mathbf{31}_1$, $\mathbf{32}_1$, connected at a base end thereof to the swinging support portion 19*a*, 20*a*, a second support wall portion $\mathbf{31}_2$, $\mathbf{32}_2$ connected to the swinging support portion 19*a*, 20*a* with its base end opposed to the first support wall portion $\mathbf{31}_1$, $\mathbf{32}_1$, in a direction along the axis of the rocker shaft 22, and a tip-end connecting portion 19*b*, 20*b* which interconnects tip ends of the support wall portions $\mathbf{31}_1$, $\mathbf{31}_2$ and $\mathbf{32}_1$, $\mathbf{32}_2$ forming a pair. Tappet screws 27, 27 are threadedly inserted in the tip-end connecting portions 19*b* and 20*b* for advancing and retreating movements to abut against upper ends of the stems 13 of the intake valves VI. The free rocker arm 21 is integrally provided with a swinging support portion 21*a* swingably supported on the rocker shaft 22, a first support wall portion $\mathbf{33}_1$ connected at its base end to the swinging support portion 21*a*, a second support wall portion $\mathbf{33}_2$ connected at its base end to the swinging support portion 21*a* in an opposed relation to the first support wall portion $\mathbf{33}_1$ in a direction along the axis of the rocker shaft 22.

An opening 34 which opens vertically is provided between the swinging support portion 19*a* and the tip-end connecting portion 19*b* of the first driving rocker arm 19 in such a manner that opposite sides of the opening 34 are delimited by the first and second support wall portions $\mathbf{31}_1$ and $\mathbf{31}_2$. A cylindrical roller 28 is rotatably supported on the first driving rocker arm 19 to come into rolling contact with the low-speed valve operating cam 25 in such a manner that it is disposed in the opening 34. An opening 35 which opens vertically is provided between the swinging support portion 20*a* and the tip-end connecting portion 20*b* of the second driving rocker arm 20 in such a manner that opposite sides of the opening 35 are delimited by the first and second support wall portions $\mathbf{32}_1$ and $\mathbf{32}_2$. A cylindrical roller 29 is rotatably supported on the second driving rocker arm 20 to come into rolling contact with the low-speed valve operating cam 25 in such a manner that the cylindrical roller 29 is disposed in the opening 35. Further, an opening 36, which opens on a side opposite to the rocker shaft 22 and vertically, is provided in the free rocker arm 21 in such a manner that opposite sides of the opening 36 are delimited by the first and second support wall portions $\mathbf{33}_1$ and $\mathbf{33}_2$, and a cylindrical roller 30 is rotatably supported on the free rocker arm 21 to come into rolling contact with the high-speed valve operating cam 26 in such a manner that it is disposed in the opening 36.

A bottomed fitting bore $\mathbf{37}_1$, which opens at an end adjacent the free rocker arm 21, is provided in the first support wall portion $\mathbf{31}_1$ of the first driving rocker arm 19 opposite to the free rocker arm 21 in parallel to the axis of the rocker shaft 22, and a second fitting bore $\mathbf{37}_2$, which opens at opposite ends thereof, is provided in the second support wall portion $\mathbf{31}_2$ coaxially with the first fitting bore $\mathbf{37}_1$. A first fitting bore $\mathbf{38}_1$, which opens at opposite ends thereof, is provided in the first support wall portion $\mathbf{32}_1$ of the second driving rocker arm 20 adjacent the free rocker arm 21 in parallel to the axis of the rocker shaft 22, and a second bottomed fitting bore $\mathbf{38}_2$, which opens at an end adjacent the free rocker arm 21, is provided in the second support wall portion $\mathbf{32}_2$ coaxially with the first fitting bore $\mathbf{38}_1$. A first fitting bore $\mathbf{39}_1$, which opens at opposite ends thereof, is provided in the first support wall portion $\mathbf{33}_1$ of the free rocker arm 21 adjacent the first driving rocker arm 19 in parallel to the axis of the rocker shaft 22, and a second fitting bore $\mathbf{39}_2$, which opens at opposite ends thereof, is provided in the second support wall portion $\mathbf{33}_2$ coaxially with the first fitting bore $\mathbf{39}_1$.

One end of a cylindrical support shaft 41 is fitted into the first fitting bore $\mathbf{37}_1$ in the first driving rocker arm 19, until it abuts against a closed end of the first fitting bore $\mathbf{37}_1$, and the other end of the support shaft 41 is fitted into the fitting bore $\mathbf{37}_2$. One end of a cylindrical support shaft 42 is fitted into the first fitting bore $\mathbf{38}_1$ in the second driving rocker arm 20, and the other end of the support shaft 42 is fitted into the second fitting bore $\mathbf{38}_2$, until it abuts against a closed end of the second fitting bore $\mathbf{38}_2$. Further, opposite ends of a cylindrical support shaft 43 are fitted into the first and second fitting bores $\mathbf{39}_1$ and $\mathbf{39}_2$ in the free rocker arm 21, respectively.

Figure 5:
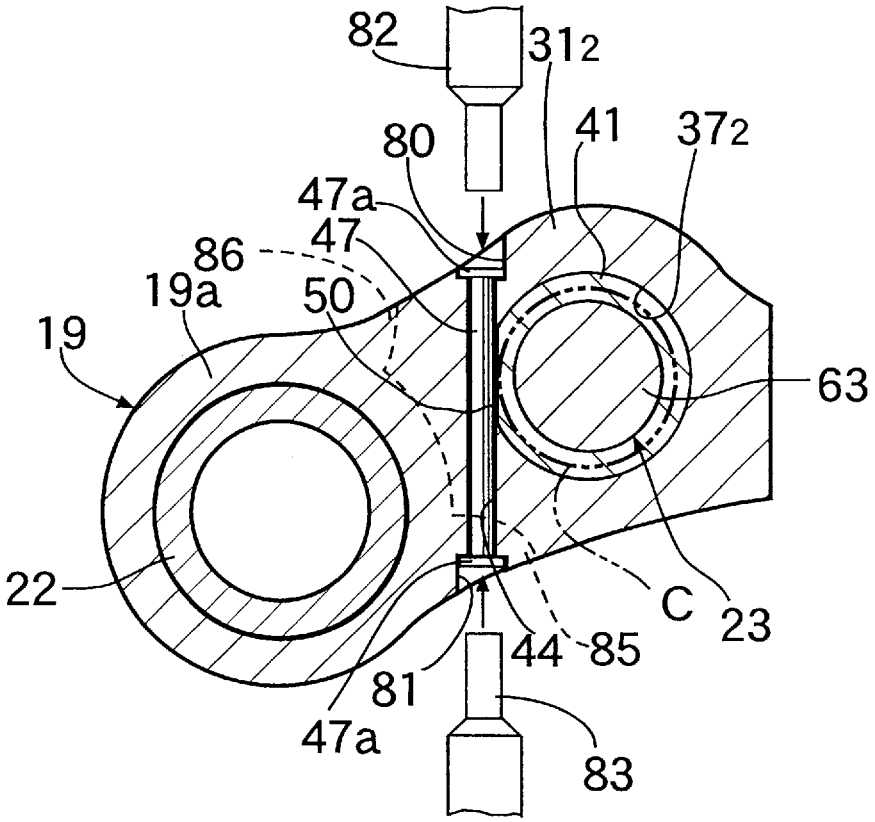

Referring also to FIG. 5, an insertion bore 44 is provided in the second support wall portion $\mathbf{31}_2$ of the first driving rocker arm 19, and extends rectilinearly in a direction intersecting a straight line interconnecting axes of the rocker shaft 22 and the second fitting bore $\mathbf{37}_2$ to lead to an inner surface of the second fitting bore $\mathbf{37}_2$. The following recesses are also provided in the second support wall portion $\mathbf{31}_2$: a first recess 80 which leads to an upper end of the insertion bore 44 and opens into an upper surface of the second support wall portion $\mathbf{31}_2$, and a second recess 81 which leads to a lower end of the insertion bore 44 and opens into a lower surface of the second support wall portion $\mathbf{31}_2$. The first and second recesses 80 and 81 are formed with their diameters larger than that of the insertion bore 44.

Figure 6:
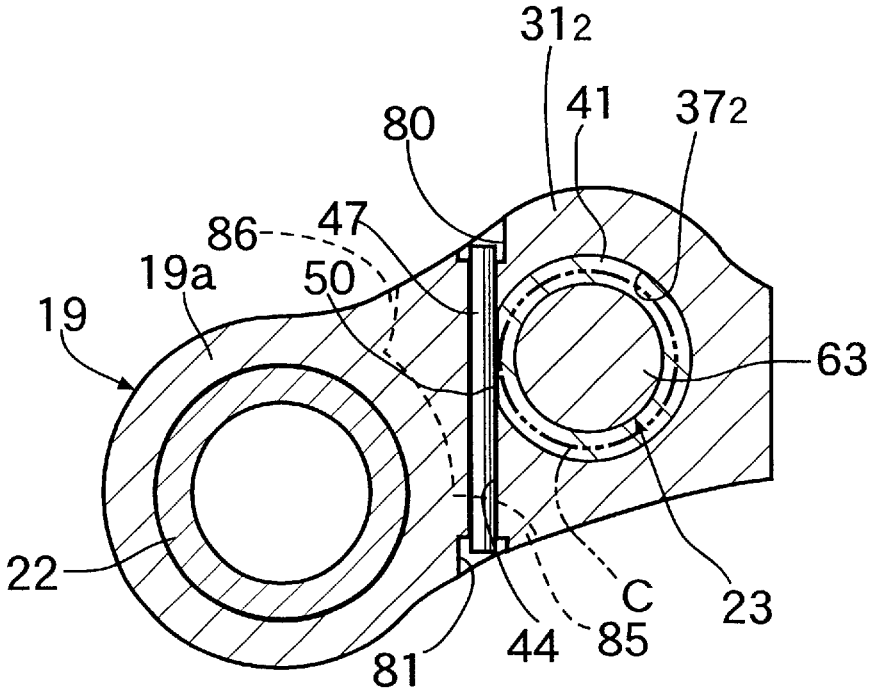

On the other hand, an engage groove 50 is provided in an outer surface of the support shaft 41 in correspondence to an opening in the insertion bore 44 leading to the inner surface of the second fitting bore $\mathbf{37}_2$, and extends along a direction tangent to a phantom circle C about the axis of the support shaft 41. A pin 47 extending rectilinearly is inserted into the insertion bore 44 and engaged at its intermediate portion into the engage groove 50, as shown in FIG. 6.

Opposite ends of the pin 47 inserted in the insertion bore 44 are caulked by flat punches 82 and 83 having outside diameters smaller than inside diameters of the recesses 80 and 81, as shown in FIG. 5, and caulked portions 47*a*, 47*a* formed by crushing the opposite ends into a disk shape by such caulking are brought into engagement with steps between the recesses 80 and 81 and the insertion bore 44, whereby the support shaft 41 is fixed to the first driving rocker arm 19.

The support shaft 42 is fixed to the first support wall portion $\mathbf{32}_1$ of the second driving rocker arm 20 in a structure similar to the structure in which the support shaft 41 is fixed to the first driving rocker arm 19. More specifically, a pin 48, which is inserted into an insertion bore 45 provided in the first support wall portion $\mathbf{32}_1$ of the second driving rocker arm 20 and which is caulked at its opposite ends, is engaged into an engage groove 51 provided in an outer surface of the support shaft 42 fitted into the first fitting bore $\mathbf{38}_1$.

Further, the support shaft 43 is fixed to the first support wall portion $\mathbf{33}_1$ of the free rocker arm 21 in a structure similar to the structure in which the support shaft 41 is fixed to the first driving rocker arm 19 as well as the structure in which the support shaft 42 is fixed to the second driving rocker arm 20. More specifically, a pin 49, which is inserted into an insertion bore 46 provided in the first support wall portion $\mathbf{33}_1$ of the free rocker arm 21 and which is caulked at its opposite ends, is engaged into an engage groove 52 provided in an outer surface of the support shaft 43 fitted into the first fitting bore $\mathbf{39}_1$.

Each of the depths of the engage grooves 50, 51 and 52 is set at a value which is smaller than one half of the radius of each of the pins 47, 48 and 49 corresponding to the engage grooves 50, 51 and 52, preferably, set at a value which is close to one half of the radius of each pin 47, 48, 49. By setting the depths as described above, not only the processing for defining the engage grooves 50, 51 and 52 in the support shafts 41, 42 and 43 is facilitated, but also it is possible to avoid a reduction in rigidity of the support shafts 41, 42 and 43 due to the provision of the engage grooves 50 to 54 to the utmost.

The hardness of at least those portions of the pins 47 to 49 which are engaged in the engage grooves 50 to 52, e.g., those portions of the pins 47 to 49 which are inserted in the insertion bores 44 to 46 in this embodiment, is set higher than the hardness of opposite ends of the pins 47 to 49, e.g., those ends of the pins 47 to 49 which protrude from the insertion bores 44 to 46 in this embodiment. Each of the pins 47 to 49 is made of, for example, JIS SUJ2, but the hardness of a portion of the outer surface of each of the pins 47 to 49 is increased by subjecting an axial intermediate portion of each of the pins 47 to 49, for example, to a high-frequency hardening. Thus, the hardness of at least those portions of the pins 47 to 49 which are engaged in the engage grooves 50 to 52 assumes a value, for example, in a range of 579 to 832 in unit of $H_v$ by the high-frequency hardening, and the hardness of the opposite ends of the pins 47 to 49, which are un-hardened areas, assumes a value in a range of 180 to 260 in unit of $H_v$.

Needle bearings 53 are interposed between the roller 28 and the support shaft 41 and between the first and second support wall portions $\mathbf{31}_1$ and $\mathbf{31}_2$ of the first driving rocker arm 19. Needle bearings 54 are interposed between the roller 29 and the support shaft 42 and between the first and second support wall portions $\mathbf{32}_1$ and $\mathbf{32}_2$ of the second driving rocker arm 20. Needle bearings 55 are interposed between the roller 30 and the support shaft 43 and between the first and second support wall portions $\mathbf{33}_1$ and $\mathbf{33}_2$ of the free rocker arm 21.

Figure 7:
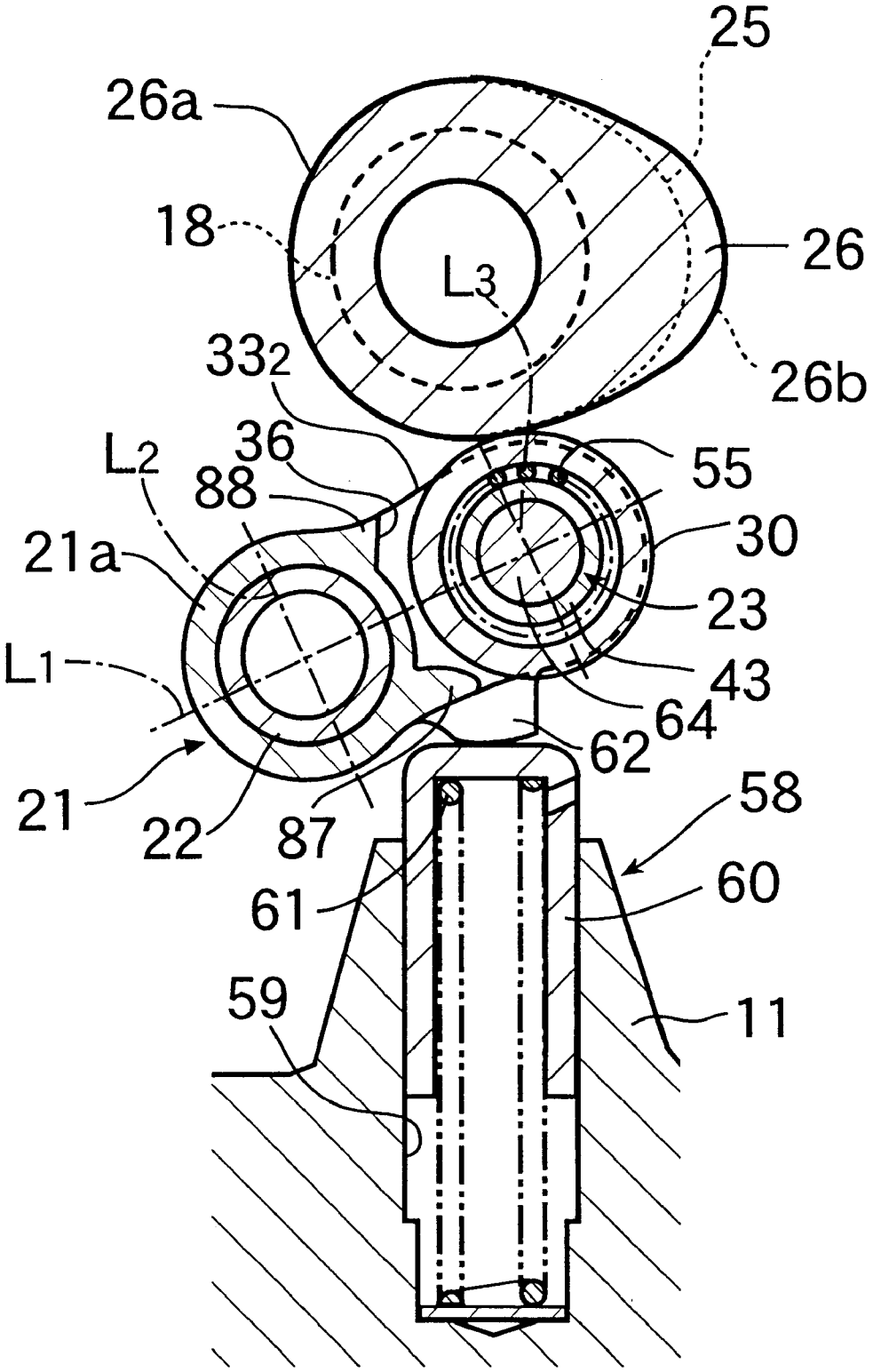

Referring to FIG. 7, a lost motion mechanism 58 is provided in the cylinder head 11 below the free rocker arm 21, and serves as an urging means for applying a spring force to the free rocker arm 21 in a direction to bring the roller 30 of the free rocker arm 21 into rolling contact with the high-speed valve operating cam 26. The lost motion mechanism 58 is comprised of a bottomed cylindrical lifter 60 which is slidably fitted in a bottomed slide bore 59 provided in the cylinder head 11 and which opens at its upper portion, and a spring 61 mounted under compression between a closed end of the slide bore 59 and the lifter 60.

On the other hand, the free rocker arm 21 includes a receiving portion 62 which is in contact with an upper end of the lifter 60 to receive the spring force from the lost motion mechanism 58. The receiving portion 62 is integrally provided on the second support wall portion $\mathbf{33}_2$ in such a manner that the pin 49 is inserted into and fixed in one $\mathbf{33}_1$ of the first and second support wall portions $\mathbf{33}_1$ and $\mathbf{33}_2$ included in the free rocker arm 21 to fix the support shaft 43, and the receiving portion 62 is disposed in a position radially outside the support shaft 43 on a diagram of projection onto a plane perpendicular to the axis of the support shaft 43.

Moreover, the receiving portion 62 is integrally provided on the second support wall portion $\mathbf{33}_2$ in a region corresponding to at least a portion of that section of the support shaft 43 which is fitted in the second support wall portion $\mathbf{33}_2$. In other words, because the second fitting bore $\mathbf{39}_2$, into which the support shaft 43 is fitted, is provided in the second support wall portion $\mathbf{33}_2$ over the entire width of the support shaft 43 along its axis in this embodiment, the receiving portion 62 may be disposed within the width of the second support wall portion $\mathbf{33}_2$. In this embodiment, the receiving portion 62 extending over the substantially entire width of the second support wall portion $\mathbf{33}_2$ is integrally provided at a lower portion of the second support wall portion $\mathbf{33}_2$ in the position radially outside the support shaft 43 so as to bulge downwards to abut against the lifter 60 of the lost motion mechanism 58 disposed below the free rocker arm 21.

The receiving portion 62 is integrally provided at the lower portion of the second support wall portion $\mathbf{33}_2$ in such a manner that it is disposed between (1) a straight line $L_2$ extending through the axis of the rocker shaft 22 in a direction perpendicular to a straight line $L_1$ extending through the axis of the rocker shaft 22 and the axis of the support shaft 43 and (2) a straight line $L_3$ extending through the axis of the support shaft 43 in a direction perpendicular to the straight line $L_1$.

Referring carefully to FIGS. 1 to 5, a lower connecting wall 85 interconnecting lower portions of base ends of the first and second support wall portions $\mathbf{31}_1$ and $\mathbf{31}_2$ is projectingly provided at the swinging support portion 19*a* of the first driving rocker arm 19 in such a manner that it is in proximity to and opposed to an outer peripheral surface of a lower portion of the roller 28. An upper connection wall 86 interconnecting upper portions of the base ends of the first and second support wall portions $\mathbf{31}_1$ and $\mathbf{31}_2$ is also projectingly provided at the swinging support portion 19*a* of the first driving rocker arm 19 in such a manner that it is in proximity to and opposed to an outer peripheral surface of an upper portion of the roller 28. The distance between the lower connecting wall 85 and the roller 28 is set smaller than the distance between the upper connecting wall 86 and the roller 28. The lower connecting wall 85 is in proximity to and opposed to the outer peripheral surface of the lower portion of the roller 28 to such an extent that an oil can be once retained between the lower connecting wall 85 and the roller 28.

Moreover, the lower connecting wall 85 is connected to the lower portion of the second support wall portion $\mathbf{31}_2$ at a location corresponding to the second recess 81 for accommodating the caulked lower end of the pin 47 for fixing the support shaft 41 to the first driving rocker arm 19. The face of the swinging support portion 19*a*, which is opposed to the roller 28 between the lower and upper connecting walls 85 and 86, is formed into a curved-face shape corresponding to the outer peripheral surface of the roller 28.

The face of the tip-end connecting portion 19*b*, which is opposed to the roller 28, is formed into a curved-face shape, so that the distance between the face and the roller 28 becomes smaller at a lower location. Thus, in an area corresponding to the axially lower half of the tappet screw 27, the thickness of the tip-end connecting portion 19*b* in a direction perpendicular to the axis of the tappet screw 27 is larger than that in an area corresponding to the axially upper half of the tappet screw 27.

The face of the swinging support portion 20*a* of the second driving rocker arm 20 which is opposed to the roller 29 and the face of the tip-end connecting portion 20*b* which is opposed to the roller 29, are formed as in the swinging support portion 19*a* and the tip-end connecting portion 19*b* in the first driving rocker arm.

Referring carefully to FIG. 7, a lower connecting wall 87 interconnecting lower portions of base ends of the first and second wall portions $\mathbf{33}_1$ and $\mathbf{33}_2$ is projectingly provided on the swinging support portion 21*a* of the free rocker arm 21 in such a manner that it is in proximity to and opposed to an outer peripheral surface of a lower portion of the roller 30. An upper connecting wall 88 interconnecting upper portions of the base ends of the first and second wall portions $\mathbf{33}_1$ and $\mathbf{33}_2$ is also projectingly provided on the swinging support portion 21*a* of the free rocker arm 21 in such a manner that it is in proximity to and opposed to an outer peripheral surface of an upper portion of the roller 30. The distance between the lower connecting wall 87 and the roller 30 is set smaller than the distance between the upper connecting wall 88 and the roller 30. The lower connecting wall 87 is in proximity to and opposed to the outer peripheral surface of the lower portion of the roller 30 to such an extent that the oil can be once retrained between the lower connecting wall 87 and the roller 30.

Moreover, the lower connecting wall 87 is connected to the lower portion of the first support wall portion $\mathbf{33}_1$ at a location corresponding to the second recess 81 for accommodating the caulked lower end of the pin 47 for fixing the support shaft 43 to the free rocker arm 21, and is also connected to the second support wall portion $\mathbf{33}_2$ at a location corresponding to a receiving portion 92 which is projectingly provided at the lower portion of the second support wall $\mathbf{33}_1$ to abut against the lost motion mechanism 58. The face of the swinging support portion 21*a*, which is opposed to the roller 30 between the lower and upper connecting walls 87 and 88, is formed into a curved-face shape corresponding to the outer peripheral surface of the roller 30.

The associative operation switching means 23 includes a timing piston 63 capable of switching the associative operation and the release of the associative operation of the first driving rocker arm 19 and the free rocker arm 21 adjacent each other, a cylindrical switching piston 64 capable of switching the associative operation and the release of the associative operation of the free rocker arm 21 and the second driving rocker arm 20 adjacent each other, a bottomed cylindrical limiting member 65 which is in contact with the switching piston 64 on a side opposite to the timing piston 63, and a return spring 66 for biasing the limiting member 65 toward the switching piston 64.

The timing piston 63 is slidably fitted in the support shaft 41 in the first driving rocker arm 19, and a hydraulic pressure chamber 67 is defined between the closed end of the fitting bore $\mathbf{37}_1$ with one end of the support shaft 41 fitted therein and one end of the timing piston 63. An oil passage 68 is provided, for example, coaxially within the rocker shaft 22 and connected to a hydraulic pressure source through a control valve (both not shown), and a communication bore 69 is provided in the rocker shaft 22 to ensure that a communication passage 70 provided in the first support wall portion $\mathbf{33}_1$ of the first driving rocker arm 19 with one end leading to the hydraulic pressure chamber 67 is normally in communication with the oil passage 68.

Figure 8:
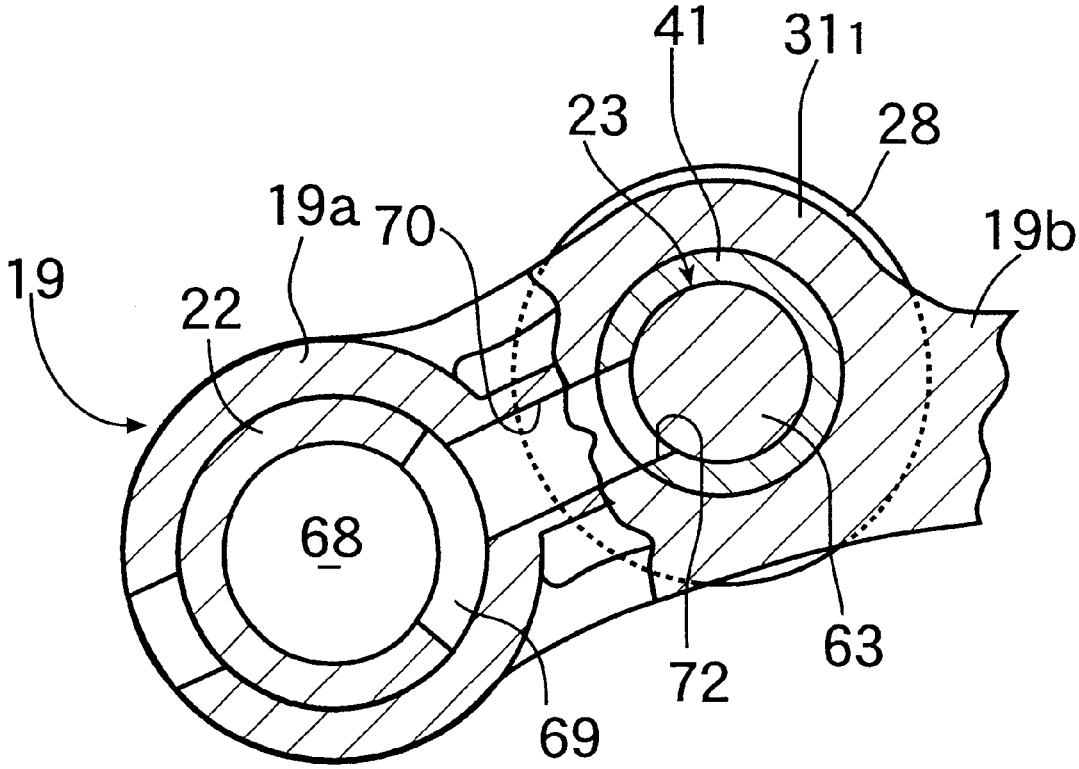

Referring also to FIG. 8, the communication passage 70 is provided in the first driving rocker arm 19 on the side of the first support wall portion $\mathbf{31}_1$ to extend along a plane substantially perpendicular to a direction of the arrangement of the rocker arms 19, 20 and 21, i.e., in a direction along the axis of the rocker shaft 22 in this embodiment, and has such a cross sectional shape with a length longer in a direction perpendicular to the direction of arrangement of the rocker arms 19, 20 and 21 than the length in the direction substantially parallel to the direction of arrangement of the rocker arms 19, 20 and 21. The communication bore 69 is provided in the rocker shaft 22 in a range larger in a circumferential direction of the rocker shaft 22 than a range in which the communication passage 70 faces the outer surface of the rocker shaft 22, in order to ensure that the oil passage 68 is normally in communication with the communication passage 70, irrespective of the swinging state of the first driving rocker arm 19. Moreover, the other end of the communication passage 70 opens into a side of the first driving rocker arm 19, and an intermediate portion of the communication passage 70 is blocked by the rocker shaft 22.

Figure 9:
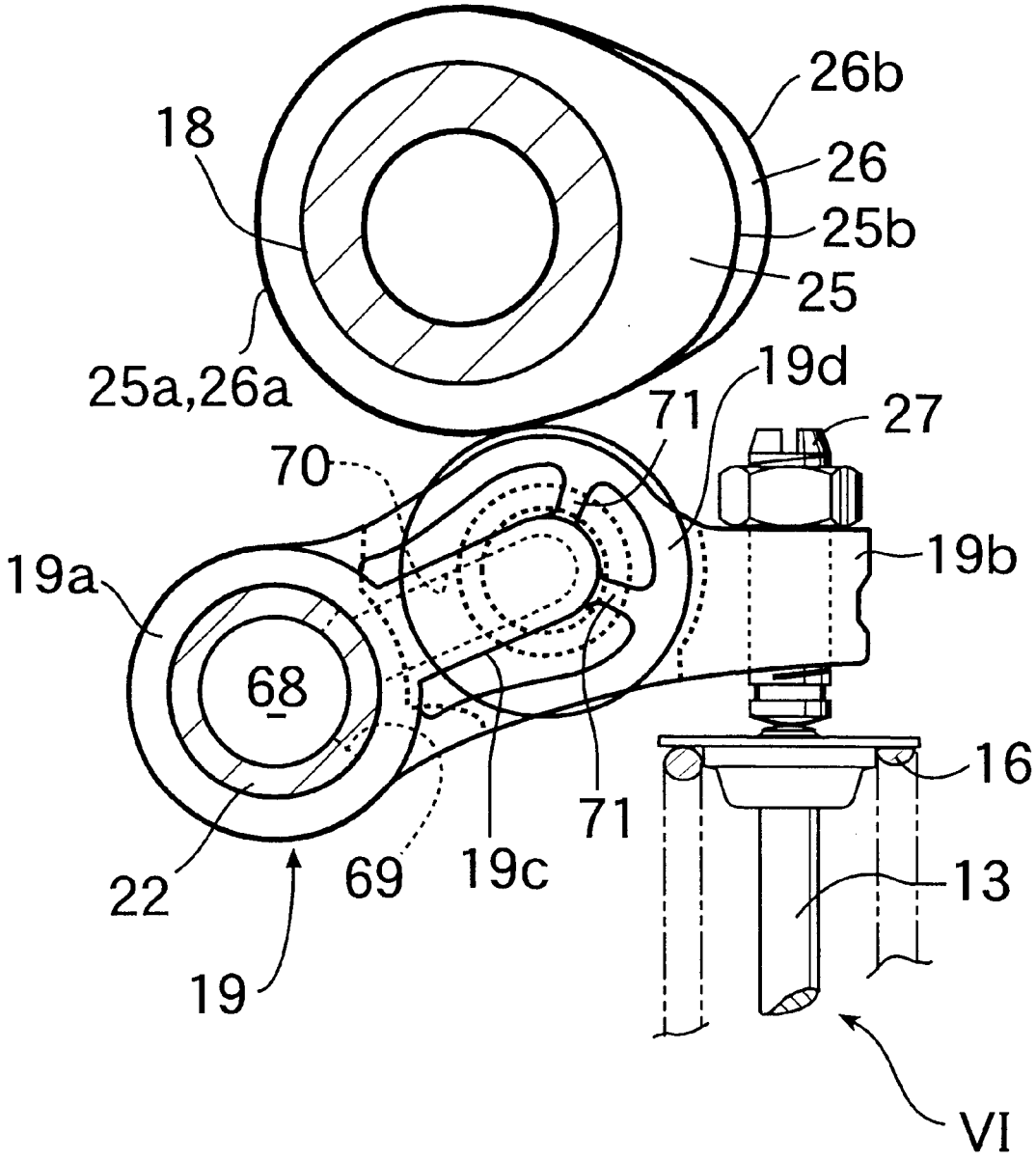

Referring also to FIG. 9, a bulge portion 19*c* bulging outwards to define the communication passage 70 is provided on an outer surface of the first driving rocker arm 19 at one end in the direction of arrangement of the rocker arms 19 to 21. A plurality of, e.g., two ribs 71, 71 are provided between a side edge 19*d* and the bulge portion 19*c* on the outer surface of the first driving rocker arm 19.

The communication passage 70 is provided in the first driving rocker arm 19 in such a manner that a portion thereof is disposed closer to the roller 28 than one end of the support shaft 41 in a direction parallel to the axis of the rocker shaft 22. A notch 72 having a shape corresponding to the communication passage 70 is provided in that area of the one end of the support shaft 41 which corresponds to the communication passage 70. Thus, a working oil flowing through the communication passage 70 is conducted to the hydraulic pressure chamber 67, so that its flow cannot be obstructed.

The switching piston 64 is slidably fitted in the support shaft 43 in the free rocker arm 21, so that one end thereof is in contact with the other end of the timing piston 63 for sliding movement relative to each other.

The limiting member 65 is formed into a bottomed cylindrical shape and slidably fitted in the support shaft 42 in the second driving rocker arm 20, so that a closed end of the limiting member 65 is in contact with the other end of the switching piston 64 for being capable of sliding movement relative to each other. A stop ring 73 is mounted to an inner surface of the support shaft 42 to abut against the limiting member 65 to inhibit the falling-off of the limiting member 65 from the support shaft 42. The return spring 66 is mounted between the closed end of the second fitting bore $\mathbf{38}_2$ in the second driving rocker arm 20 and the limiting member 65, and an open bore 74 is formed in the closed end of the second fitting bore $\mathbf{38}_2$.

In such associative operation switching means 23, in the low-speed operational region of the engine, the hydraulic pressure in the hydraulic pressure chamber 67 is relatively low; contact faces of the timing piston 63 and the switching piston 64 are at a location corresponding to between the first driving rocker arm 19 and the free rocker arm 21; and contact faces of the switching piston 64 and the limiting member 65 are at a location corresponding to between the free rocker arm 21 and the second driving rocker arm 20. Therefore, the rocker arms 19, 20 and 21 are in relatively swingable states, such that the intake valves VI are opened and closed at a timing and in a lift amount depending on the low-speed valve operating cams 25, 25.

In the high-speed operational region of the engine, a relatively high hydraulic pressure is applied to the hydraulic pressure chamber 67, whereby the timing piston 63 is fitted into the support shaft 43 in the free rocker arm 21, while urging the switching piston 64, and the switching piston 64 is fitted into the support shaft 42 in the second driving rocker arm 20, while urging the limiting member 65. Therefore, the rocker arms 19, 20 and 21 are brought into an integrally connected state, such that the intake valves VI are opened and closed at a timing and in a lift amount depending on the high-speed valve operating cam 26.

Figure 10:
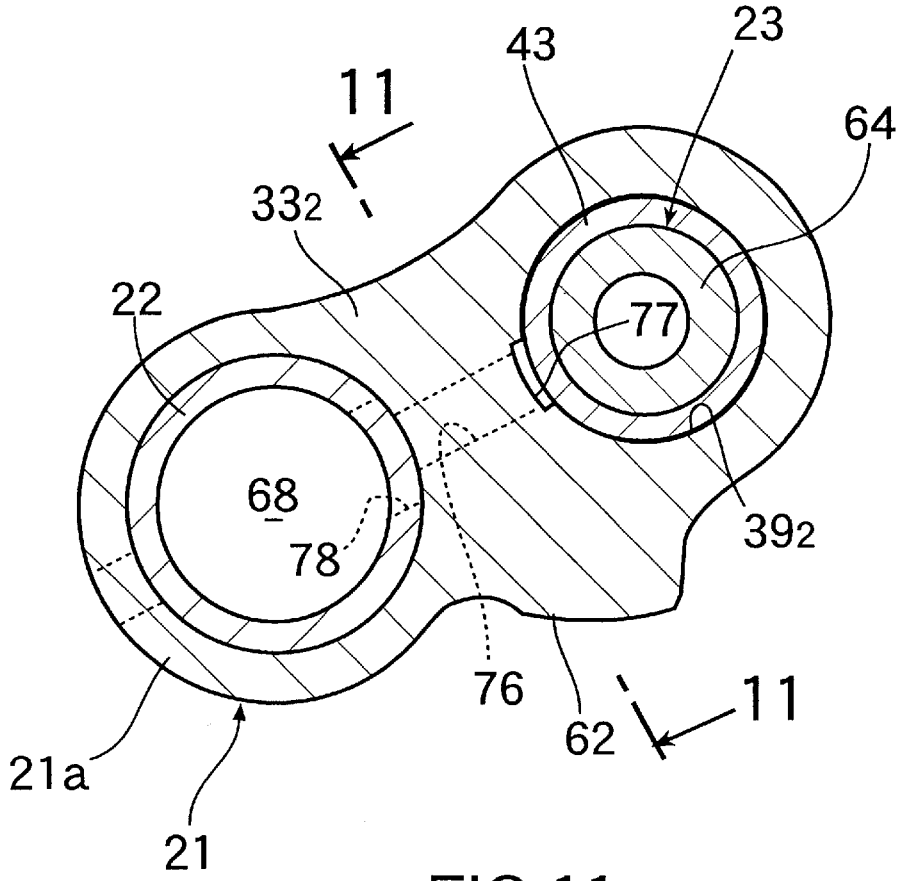
Figure 11:
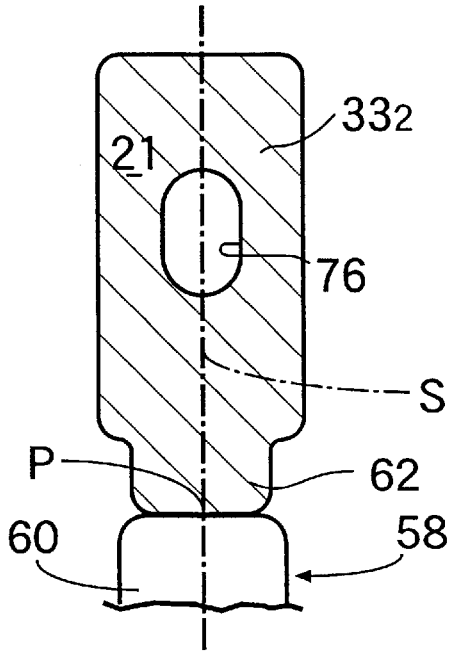

Referring also to FIGS. 10 and 11, a lubricating oil passage 76, which normally leads to the oil passage 68 in the rocker shaft 22, is provided in one of the support wall portions $\mathbf{33}_1$, and $\mathbf{33}_2$ of the free rocker arm 21 in which the receiving portion 62 is provided, i.e., in the second support wall portion $\mathbf{33}_2$, in such a manner one end of the lubricating oil passage 76 opens into the inner surface of the second fitting bore $\mathbf{39}_2$. A groove 77 is provided in the inner surface of the second fitting bore $\mathbf{39}_2$. One end of the groove 77 leads to one end of the lubricating oil passage 76, and the other end of the groove 77 opens toward the bearings 55.

The lubricating oil passage 76 is provided in the second support wall portion $\mathbf{33}_2$ to extend along a plane S extending perpendicular to the axis of the support shaft 43 and through an abutment point P between receiving portion 62 and the lifter 60 of the lost motion mechanism 58.

Moreover, the lubricating oil passage 76 is formed to have such a cross sectional shape with the length longer in the direction substantially perpendicular to the direction of arrangement of the rocker arms 19 to 21 than the length in the direction substantially parallel to the direction of arrangement of the rocker arms 19 to 21. A communication bore 78 is provided in the rocker shaft 22 in a range larger in the circumferential direction of the rocker shaft 22 than a range in which the lubricating oil passage 76 faces the outer surface of the rocker shaft 22, in order to ensure that the oil passage 68 is normally in communication with the lubricating oil passage 76, irrespective of the swinging state of the free rocker arm 21. The other end of the lubricating oil passage 76 opens into a side of the free rocker arm 21, and an intermediate portion of the lubricating oil passage 76 is blocked by the rocker shaft 22.

Each of the rocker arms 19, 20 and 21 is formed from metal by injection molding. In carrying out the metal injection molding, the following steps may be sequentially conducted: a step of kneading a starting powder material and a binder such as wax and the like, a step of granulating a compound produced in the kneading step to provide a pellet, a step of subjecting the pellet to injection molding in a mold to shape the pellet, a step of heating the shaped product to remove the binder, and a step of subjecting the resulting product to a sintering treatment.

Figure 12:
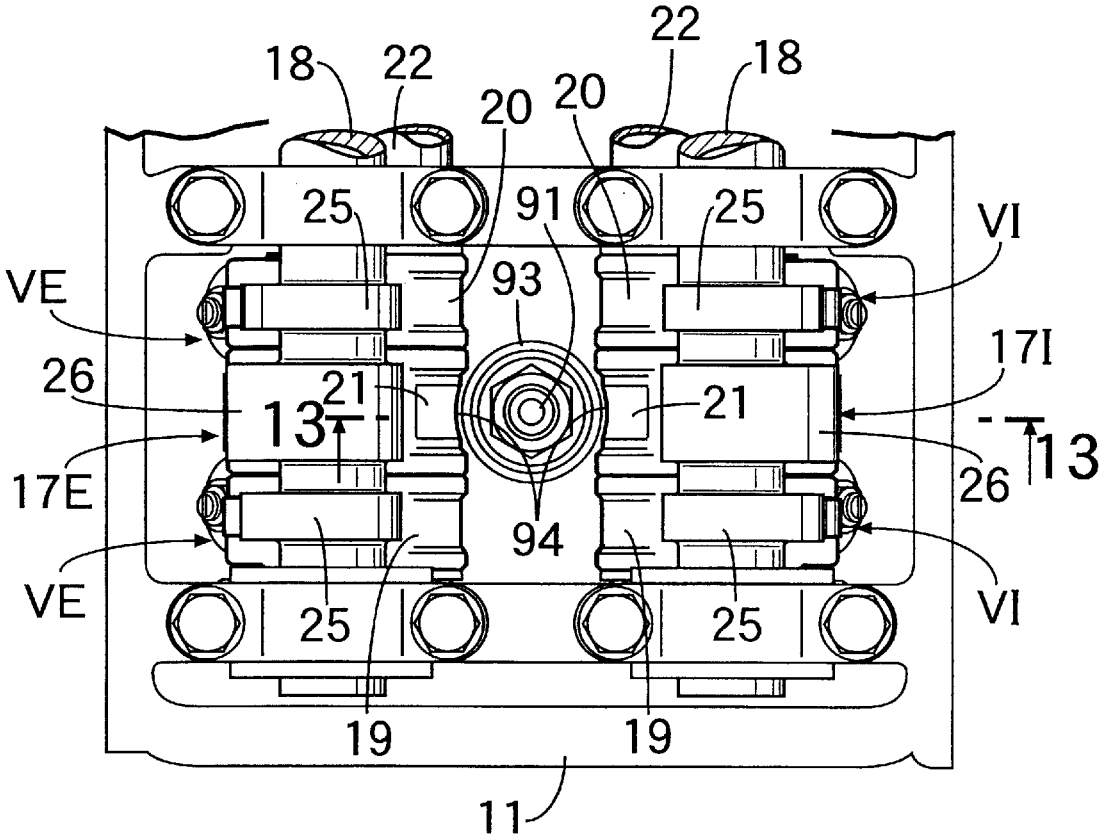
Figure 13:
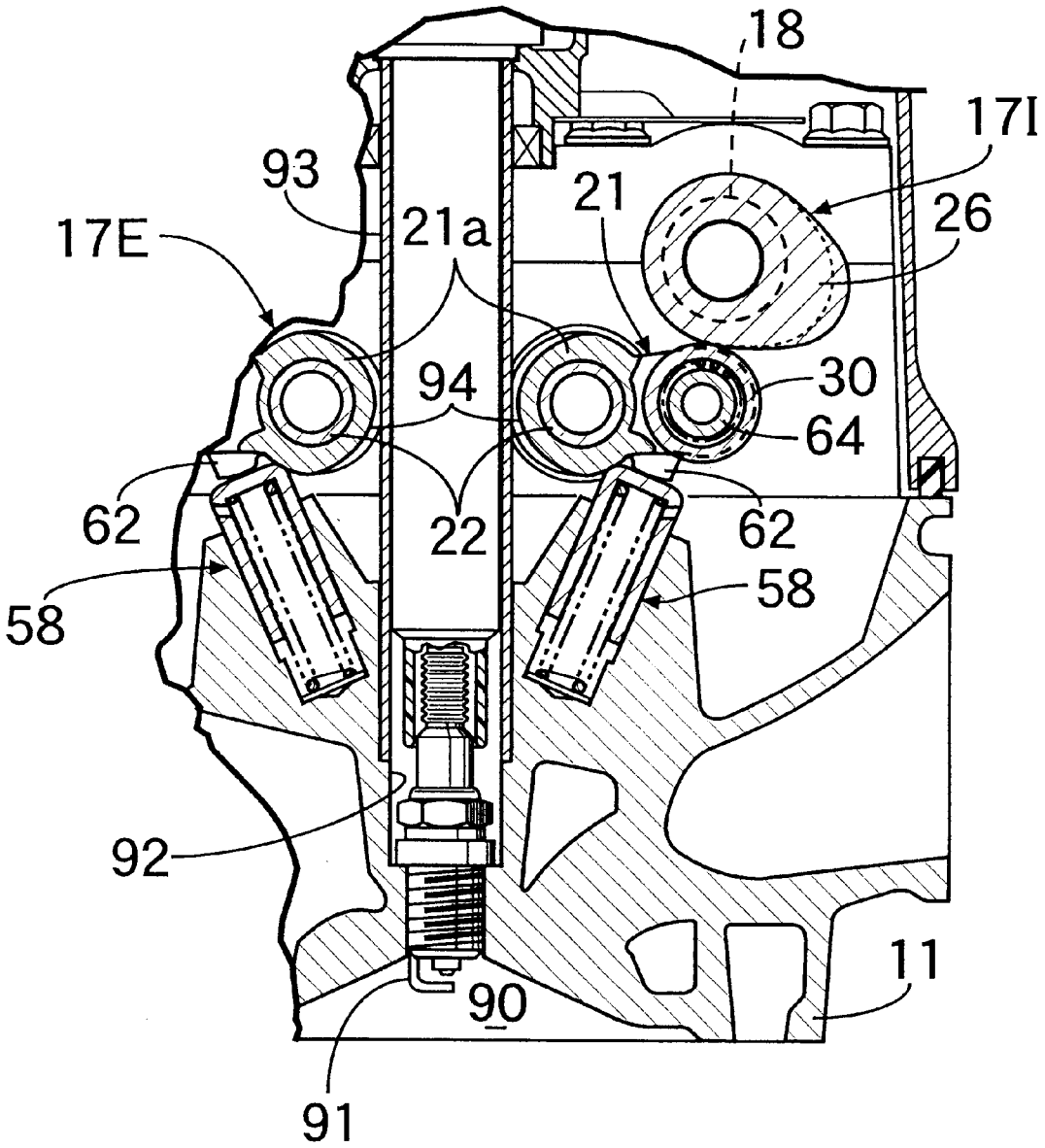

Referring to FIGS. 12 and 13, a spark plug 91 is mounted in the cylinder head 11 to face the central portion of a combustion chamber 90 in each of the cylinders. The cylinder head 11 is provided with a mounting bore 92 for mounting of the spark plug 91, and a spark plug insertion tube 93 is mounted in the cylinder head 11 to extend upwards through the mounting bore 92.

The intake-side valve operating system 17I for driving the pair of intake valves VI, VI to open and close them and the exhaust-side valve operating system 17E for driving the pair of exhaust valves VE, VE to open and close them are disposed above the cylinder head 11 in such a manner that the spark plug insertion tube 93 are sandwiched between the systems. Moreover, the exhaust-side valve operating system 17E is constructed in the same manner as is the intake-side valve operating system 17I, and hence, mutually corresponding portions of the intake-side and exhaust-side valve operating systems 17I and 17E are only shown in FIGS. 12 and 13 with the same reference characters affixed thereto, and a detailed description of the exhaust-side valve operating system 17E is omitted.

The spark plug insertion tube 93 is disposed between the free rocker arms 21, 21 included in the intake-side and exhaust-side valve operating systems 17I and 17E. A notch 94 recessed on the opposite side to the spark plug insertion tube 93 is provided in that portion of the swinging support portion 21*a* of each of the free rocker arms 21, which is opposed to the spark plug insertion tube 93.

The notch 94 is formed so that it is curved in correspondence to the outer peripheral surface of the spark plug insertion tube 93 which is circular in cross section, and the radius of curvature of the notch 94 is set larger than the radius of the outer surface of the spark plug insertion tube 93. Moreover, the notch 94 is provided at the central portion of the swinging support portion 21*a* as viewed in a direction along the axis of the rocker shaft 22. The deepest portion of the notch 94 (the center of the spark plug insertion tube 93) and a portion of the roller 30 supported on the free rocker arm 21 (preferably, the axially central portion of the roller 30 as in this embodiment) are disposed in the same plane perpendicular to the axis of turning movement of the free rocker arm 21, i.e., the axis of the rocker shaft 22.

In addition, the notch 94 is provided in the swinging support portion 21*a* within the width of the opening 36 provided in the free rocker arm 21, i.e., in a section corresponding to a portion between the first and second support walls $\mathbf{33}_1$ and $\mathbf{33}_2$ in the free rocker arm 21 to accommodate the roller 30. Arcuate bulged portions 95, 95 bulged outwards are formed at opposite ends of the swinging support portion 21*a* along the axis of the rocker shaft 22 in such a manner that the notch 94 is sandwiched between the portions 95, 95.

A lubricating oil passage 76 is provided in the second support wall $\mathbf{33}_2$ of the free rocker arm 21 to normally lead to the oil passage 68 in the rocker shaft 22 in such a manner that one end of the oil passage 76 opens into the inner surface of the second fitting bore $\mathbf{39}_2$. The other end of the lubricating oil passage 76 is disposed at a location deviated from the notch 94 along the axis of the rocker shaft 22, and opens into the outer surface of one of the bulged portions 95, 95.

Further, lower portions of the base ends of the support walls $\mathbf{33}_1$ and $\mathbf{33}_2$ of the free rocker arm 21 are interconnected by a lower connecting wall 87, and upper portions of the base ends of the support walls $\mathbf{33}_1$ and $\mathbf{33}_2$ are interconnected by an upper connecting wall 88. At least a portion of the notch 94 (the whole in this embodiment) and at least a portion of the lower connecting wall 87 (central portions of the lower and upper connecting walls 87 and 88 in this embodiment) are disposed in the same plane perpendicular to the axis of swinging movement of the free rocker arm 21, i.e., the axis of the rocker shaft 22.

Vertically extending grooves are provided in outer surfaces of those portions of support walls $\mathbf{33}_1$ and $\mathbf{33}_2$ of the free rocker shaft 22 which are closer to the swinging support portion 21*a*. These grooves define oil grooves 96, 96, with their upper ends opening in the upper portion of each of the rocker arms 19, 20 and 21, between the adjacent first driving rocker arm 19 and free rocker arm 21 as well as between the adjacent second driving rocker arm 20 and free rocker arm 21.

The operation of the first embodiment will be described below. The support shafts 41 to 43 for rotatably supporting the rollers 28 to 30 for alleviating the valve operating load are fixed to the rocker arms 19 to 21, but the opposite ends of each of the support shafts 41 to 43 are fitted in the first fitting bores $\mathbf{37}_1$, $\mathbf{38}_1$ and $\mathbf{39}_1$ and the second fitting bores $\mathbf{37}_2$, $\mathbf{38}_2$ and $\mathbf{39}_2$ in the rocker arms 19, 20 and 21, respectively. The pin 47 inserted in the insertion bore 44 provided in the second support wall portion $\mathbf{31}_2$ of the first driving rocker arm 19 is engaged in the engage groove 50 in the support shaft 41; the pin 48 inserted in the insertion bore 45 provided in the first support wall portion $\mathbf{32}_1$ of the second driving rocker arm 20 is engaged in the engage groove 51; and the pin 49 inserted in the insertion bore 46 provided in the first support wall portion $\mathbf{33}_1$ of the free rocker arm 21 is engaged in the engage groove 52. This inhibits the axial movement of the support shafts 41 to 43 and the rotation of the support shafts 41 to 43 about the axes and hence, the support shafts 41 to 43 can be fixed to the rocker arms 19 to 21 in a simple structure.

In fixing the pins 47 to 49 to the corresponding rocker arms 19 to 21, the opposite ends of each of the pins 47 to 49 inserted in the insertion bores 44 to 46 are caulked. Therefore, even if each of the pins 47 to 49 is of a small diameter, the fixing is easy, as compared with a case where the pin is press-fitted, thereby enhancing the operability to ensure that the pins 47 to 49 can be reliably fixed to the rocker arms 19 to 21.

Moreover, the pins 47 to 49 are inserted into the insertion bores 44 to 46 rather than being press-fitted into the bores, respectively. The inside diameters of the insertions bores 44 to 46 may be set with relatively large margins, relative to the outside diameters of the pins 47 to 49, and the widths of the engage grooves 50 to 52 may be also set with relatively large margins, relative to the diameters of the pins 47 to 49. In this case, even if the circumferential positions of the support shafts 41 to 43 are not established exactly, it is easy to insert the pins 47 to 49 into the insertion bores 44 to 46 to bring them into engagement in the engage grooves 50 to 52, thereby facilitating the operation of fixing the pin 47 to 49 to the rocker arms 19 to 21.

The opposite ends of each of the pins 47 to 49 are caulked by the flat punches 82 and 83 and hence, even if the caulking positions of the flat punches 82 and 83 relative to the pins 47 to 49 are slightly displaced, the opposite ends of the pins 47 to 49 can be caulked reliably by setting the diameters of the flat punches 82 and 83 larger than the diameters of the pins 47 to 49 and hence, a reduction in rigidity of each of the caulked portions due to the displacement of the caulking positions cannot be produced. Moreover, the inside diameters of the recesses 80, 81 are set larger than the outside diameters of the flat punches 82 and 83, so that the flat punches 82 and 83 can be accommodated in the recesses 80, 81 leading to the opposite ends of the insertion bores 44 to 46. Therefore, by caulking the opposite ends of the pins 47 to 49 within the recesses 80, 81, it is ensured that the caulked portions cannot protrude from the outer surfaces of the rocker arms 19 to 21. Moreover, the lengths of the insertion bores 44 to 46 and thus, of the pins 47 to 49, can be reduced by amounts corresponding to the provision of the recesses 80, 81, and the it is possible to prevent the intermediate portions of the pins 47 to 49 from being deformed due to the caulking to the utmost, thereby enhancing the accuracy of positioning of the support shafts 41 to 43 by the pins 47 to 49, and at the same time, providing reductions in entire weights of the rocker arms 19 to 21 to alleviate the inertial weights of the rocker arms 19 to 21. Thus, it is possible to conveniently accommodate the high-speed rotation of the internal combustion engine.

Further, since the hardness of at least those portions of the pins 47 to 49 which engage the engage grooves 50 to 52 (the areas subjected to the high-frequency hardening) is relatively high (e.g., in the range of 579 to 832 in unit of $H_v$), it is possible to prevent the wearing and deformation of the pins 47 to 49 to the utmost to enable the reliable positioning of the support shafts 41 to 43. In addition, since the hardness of the opposite ends of the pins 47 to 49 (the areas not subjected to the high-frequency hardening) is relatively low (e.g., in the range of 180 to 260 in unit of $H_v$), the caulking operation is facilitated, and the caulking accuracy is also enhanced.

The communication passage 70 is provided in the first driving rocker arm 19 to extend in the plane substantially perpendicular to the direction of arrangement of the rocker arms 19 to 21 to connect the oil passage 68 in the rocker shaft 22 and the hydraulic pressure chamber 67 in the associative operation switching means 23 to each other. The communication passage 70 has a cross sectional shape with a length longer in the direction substantially perpendicular to the direction of arrangement of the rocker arms 19 to 21 than the length in the direction substantially parallel to the direction of arrangement of the rocker arms 19 to 21. Therefore, it is possible to reduce, to the utmost, the space occupied in the direction substantially parallel to the direction of arrangement of the rocker arms 19 to 21 by the communication passage 70, and to correspondingly reduce the size of the first driving rocker arm 19.

Moreover, in the first driving rocker arm 19, one end of the support shaft 41 is fitted into the first fitting bores $\mathbf{37}_1$ in the first support wall portion $\mathbf{31}_1$, whereby the support shaft 41 is fixed to the first driving rocker arm 19, but the communication passage 70 is provided in the first driving rocker arm 19 on the side of the first support wall portion $\mathbf{31}_1$. Therefore, the communication passage 70 can be disposed in the first driving rocker arm 19, while avoiding an increase in thickness of the first support wall portion $\mathbf{31}_1$ for fixing the support shaft 41 supporting the roller 28. Moreover, since the notch 72 having the shape corresponding to the communication passage 70 is provided in the area of the one end of the support shaft 41 which corresponds to the communication passage 70, it is possible to dispose the communication passage 70 in more proximity to the roller 28, while ensuring a sufficient contact area of the support shaft 41 with the first fitting bore $\mathbf{37}_1$ in the first support wall portion $\mathbf{31}_1$ included in the first driving rocker arm 19 to ensure the support strength of the support shaft 41 in the first driving rocker arm 19. Thus, it is possible to more reduce the size of the first driving rocker arm 19.

In the multi-cylinder internal combustion engine as applied in this embodiment, it is possible to remarkably reduce the size of the cylinder head 11 by enabling the reduction in size of the first driving rocker arm 19, as described above.

Provided on the outer surface of the first driving rocker arm 19 at one end thereof in the axial direction of the rocker shaft 22 is the bulge portion 19*c* bulging outwards to define the communication passage 70, and the ribs 71, 71 connecting the side edge portion 19*d* and the bulge portion 19*c* on the outer surface to each other. Therefore, it is possible to reduce the weight of the first driving rocker arm 19, while ensuring the rigidity of the bulge portion 19*c* defining the communication passage 70.

Further, the communication passage 70 is provided in the first driving rocker arm 19 on the side of the first support wall portion $\mathbf{31}_1$, and the insertion bore 44 for fixing the support shaft 41 is provided in the second support wall portion $\mathbf{31}_2$ with the roller 28 sandwiched between the first and second support wall portions $\mathbf{31}_1$ and $\mathbf{31}_2$. Therefore, it is possible to avoid an increase in size of the first driving rocker arm 19 to ensure a space for provision of the insertion bore 44, and additionally, the provision of the insertion bore 44 at a location relatively spaced apart from the communication passage 70 which is cavity, is convenient for the rigidity of the first driving rocker arm 19.

The lubricating oil passage 76 is provided in the free rocker arm 21, so that it opens at one end thereof into the inner surface of the second fitting bore $\mathbf{39}_2$ and leads to the oil passage 68 in the rocker shaft 22. The groove 77 is provided in the inner surface of the second fitting bore $\mathbf{39}_2$, so that one end thereof leads to one end of the lubricating oil passage 76 and the other end opens toward the needle bearings 55. Therefore, the lubricating oil is supplied from the oil passage 68 through the lubricating oil passage 76 and the groove 77 to the needle bearings 55. Thus, the supplying of the oil to the needle bearings 55 can be performed in a simple structure in which the lubricating oil passage 76 is provided in the free rocker arm 21 and the groove 77 is provided in the inner surface of the second fitting bore $\mathbf{39}_2$. Therefore, it is unnecessary to bore the support shaft 43 for the purpose of introduction of the lubricating oil and hence, there is no possibility that a reduction in rigidity of the support shaft 43 is brought about, and the number of processing steps is decreased.

The free rocker arm 21 follows the high-speed valve operating cam 26 having the cam profile for the high-speed operation of the engine, and has a relatively large inertial weight, and the load to the needle bearings 55 is relatively large. However, the lubricating oil can be supplied effectively to the needle bearings 55 in the simple structure as described above, the load applied to the needle bearings 55 can be alleviated.

Moreover, the lubricating oil passage 76 is formed to have a cross sectional shape with the length longer in the direction substantially perpendicular to the direction of arrangement of the rocker arms 19 to 21 than the length in the direction substantially parallel to the direction of arrangement of the rocker arms 19 to 21. Thus, the space occupied in the direction parallel to the direction of arrangement of the rocker arms 19 to 21 by the lubricating oil passage 76, and the size of the free rocker arm 21 can be reduced, whereby the size of the cylinder head 11 of the multi-cylinder internal combustion engine can be reduced.

In the free rocker arm 21, the lubricating oil passage 76 is provided in the second support wall portion $\mathbf{33}_2$, and the insertion bore 46 for fixing the support shaft 43 is provided in the first support wall portion $\mathbf{33}_1$. Therefore, it is possible to ensure the space for provision of the insertion bore 46, while avoiding an increase in size of the free rocker arm 21. In addition, the provision of the insertion bore 44 at the location relatively spaced apart from the lubricating oil passage which is the cavity, is convenient for the rigidity of the free rocker arm 21.

The free rocker arm 21 includes the receiving portion 62 which is in contact with the lifter 60 of the lost motion mechanism 58. The receiving portion 62 is disposed at the position radially outside the support shaft 43 in the diagram of projection onto the plane perpendicular to the axis of the support shaft 43, and is integrally provided on the second support wall portion $\mathbf{33}_2$ in the range corresponding to at least a portion of the area of the support shaft 43 which is fitted in the second support wall portion $\mathbf{33}_2$. In other words, the receiving portion 62 is integrally provided on the second support wall portion $\mathbf{33}_2$ in such a manner that at least a portion of the area of the support shaft 43, which is fitted in the second support wall portion $\mathbf{33}_2$, exists on the plane perpendicular to the axis of the support shaft 43 and extending through the abutment point P between the receiving portion 62 and the lost motion mechanism 58. In this embodiment, the second fitting bore $\mathbf{39}_2$ with the support shaft 43 fitted therein is provided in the second support wall portion $\mathbf{33}_2$ over the entire width along the axis of the support shaft 43. Therefore, the receiving portion 62 is disposed radially outside the support shaft 43 within the width of the second support wall portion $\mathbf{33}_2$ and integrally provided at the lower portion of the second support wall $\mathbf{33}_2$ to abut against the lifter 60 of the lost motion mechanism 58 disposed below the free rocker arm 21.

Therefore, the receiving portion 62 can be disposed axially outside the roller 30, thereby simplifying the structure of the free rocker arm 21. Since the receiving portion 62 cannot protrude from the free rocker arm 21 along the axial direction of the support shaft 43, it is possible to avoid an increase in size of the free rocker arm 21 in the axial direction of the support shaft 43, and the inertial weight is decreased. Thus, it is possible to conveniently accommodate the high-speed rotation of the internal combustion engine. Especially, when the plurality of rocker arms 19, 20 and 21 are disposed adjacent one another in the axial direction of the rocker shaft 22 for each of the cylinders in the multi-cylinder internal combustion engine as in this embodiment, the space in the direction along the axis of the rocker shaft 22, i.e., the axes of the support shafts 41, 42 and 43 is limited, but a surplus space is provided in the direction perpendicular to the axes of the support shafts 41 to 43. Thus, the receiving portion 62 and the lost motion mechanism 58 can be disposed utilizing an unoccupied space effectively.

The provision of the receiving portion 62 enhances the support rigidity of the support shaft 43 on the second support wall portion $\mathbf{33}_2$.

Further, the receiving portion 62 is integrally provided at the lower portion of the second support wall $\mathbf{33}_2$ in such manner that it is disposed between (1) the straight line $L_2$ extending through th e axis of the rocker shaft 22 in a direction perpendicular to the straight line $L_1$ extending through the axis of the rocker shaft 22 and the axis of the support shaft 43 and (2) the straight line $L_3$ extending through the axis of the support shaft 43 in a direction perpendicular to the straight line $L_1$. Therefore, it is possible to avoid an increase in size of the free rocker arm 21 due to the provision of the receiving portion 62, and to increase the rigidities of the supported portion of the free rocker arm 21 on the rocker shaft 22 and the supported portion of the free rocker arm 21 on the support shaft 43. Namely, the lower portion of the second support wall $\mathbf{33}_2$ can be formed into an upward recessed shape, if the receiving portion 62 is not provided, but the receiving portion 62 is disposed, effectively utilizing an unoccupied space produced by the recessed portion. Therefore, it is possible to avoid the increase in size of the free rocker arm 21. In addition, the rigidities of the supported portion of the free rocker arm 21 on the rocker shaft 22 and the supported portion of the free rocker arm 21 on the support shaft 43 are increased by the provision of the receiving portion 62 with such recessed portion eliminated.

Moreover, the support shaft 43 is fixed by the pin 49 on the side of the first support wall $\mathbf{33}_1$, and the receiving portion 62 Is provided on the second support wall $\mathbf{33}_2$. Therefore, the size and disposition of the insertion bore 46 for insertion and fixing of the pin 49 cannot be limited by the receiving portion 62, and it is possible to ensure that the load from the lost motion mechanism 58 is difficult to be applied to the pin 49, thereby increasing the fixing strength of the support shaft 43. In addition to this, since the receiving portion 62 is provided on the second support wall $\mathbf{33}_2$, it is possible to avoid a reduction in rigidity of the second support wall $\mathbf{33}_2$, despite the provision of the lubricating oil passage 76 which is the cavity in the second support wall $\mathbf{33}_2$, and to compensate for a reduction in weight of the second support wall $\mathbf{33}_2$ caused by the lubricating oil passage 76 being the cavity, by the receiving portion 62, thereby improving the balance of the weight of the support wall portions $\mathbf{33}_1$ and $\mathbf{33}_2$.

Further, the free rocker arm 21 is supported on the rocker shaft 22 in such manner that the first support wall portion $\mathbf{33}_1$ provided with the insertion bore 46 for fixing the support shaft 43 is disposed on the side of the first driving rocker arm 19. The second driving rocker arm 20 is supported on the rocker shaft 22 in such manner that the first support wall portion $\mathbf{32}_1$ provided with the insertion bore 45 for fixing the support shaft 42 is disposed on the side of the first driving rocker arm 19. The support shafts 43 and 42 are fixed to the free rocker arm 21 and the second driving rocker arm 20 on the side where the timing piston 63 and the switching piston 64 of the associative operation switching means 23 are inserted. Therefore, the insertion of the pistons 63 and 64 into the support shafts 43 and 42 is smooth and thus, the associative switching operation of the associative operation switching means 23 is smooth.

Each of the rocker arms 19 to 21 is formed from metal by injection molding. The communication passage 70 which is out of round, the fitting bores $\mathbf{37}_1$ and $\mathbf{37}_2$ and the insertion bore 44 can be defined simultaneously with the formation of the first driving rocker arm 19, and the fitting bores $\mathbf{38}_1$ and $\mathbf{38}_2$, the insertion bore 45 and the open bore 74 can be defined simultaneously with the formation of the second driving rocker arm 20. The lubricating oil passage 76 which is out of round, the fitting bores $\mathbf{39}_1$ and $\mathbf{39}_2$ and the insertion bore 46 can be defined simultaneously with the formation of the free rocker arm 21. Therefore, the number of post-processings of the rocker arms 19 to 21 can be decreased to the utmost to provide an enhancement in productivity. It is possible to simply form the relatively complicated structure in which the lower connecting walls 85, 87 and the upper connecting walls 86, 88 protrude from the swinging support portions 19*a* to 21*a*, and to easily form the rocker arms 19 to 21 each having an optimal shape with an increase in rigidity and a reduction in weight taken into consideration. Further, the free rocker arm 21 has the receiving portion 62 integrally provided thereon, and it is possible to easily form the free rocker arm 21 having the receiving portion 62 integrally provided thereon by the metal injection molding.

In the rocker arms 19 to 21, the lower connecting walls 85, 87, which interconnect the lower portions of the base ends of the pair of support walls $\mathbf{31}_1$, $\mathbf{31}_2$, $\mathbf{32}_1$, $\mathbf{32}_2$, $\mathbf{33}_1$ and $\mathbf{33}_2$ included in the rocker arms 19 to 21 and which are in proximity to and opposed to the outer peripheral surfaces of the lower portions of the rollers 28 to 30, are projectingly provided on the swinging support portions 19*a* to 21*a* swingably supported on the rocker shaft 22, and the upper connecting walls 86, 88, which interconnect the upper portions of the base ends of the support walls $\mathbf{31}_1$, $\mathbf{31}_2$, $\mathbf{32}_1$, $\mathbf{32}_2$, $\mathbf{33}_1$ and $\mathbf{33}_2$ and which are in proximity to and opposed to the outer peripheral surfaces of the upper portions of the rollers 28 to 30, are also projectingly provided on the swinging support portions 19*a* to 21*a*. Therefore, in cooperation with the formation of those faces of the swinging support portions 19*a* to 21*a*, which are opposed to the rollers 28 to 30, into the curved faces between the lower connecting walls 85, 87 and the upper connecting walls 86, 88, it is possible to increase the rigidities of supporting of the support shafts 41 to 43 by the support walls $\mathbf{31}_1$, $\mathbf{31}_2$, $\mathbf{32}_1$, $\mathbf{32}_2$, $\mathbf{33}_1$ and $\mathbf{33}_2$ and the same time, to increase the rigidities of the entire rocker arms 19 to 21, and it is possible to avoid an increase in weight due to the increases in the rigidities to the utmost by the formation of the curved faces.

Moreover, the lower connecting walls 85, 87 and the upper connecting walls 86, 88 are disposed, effectively utilizing the spaces between the rollers 28 to 30 and the swinging support portions 19*a* to 21*a*, and the sizes of the rocker arms 19 to 21 cannot be increased due to the lower connecting walls 85, 87 and the upper connecting walls 86, 88.

In addition, since the lower connecting walls 85, 87 are in proximity to and opposed to the lower portions of the rollers 28 to 30, the oil can be once retained between the lower connecting walls 85, 87 and the rollers 28 to 30, and the oil retained between the lower connecting walls 85, 87 and the rollers 28 to 30 can be conducted to the needle bearings 53 to 55 between the rollers 28 to 30 and the support shafts 41 to 43 to reduce the resistance to the rotation of the rollers 28 to 30. In this case, the oil from the above can be conducted effectively to between the lower connecting walls 85, 87 and the rollers 28 to 30, because the distances between the lower connecting walls 85, 87 and the rollers 28 to 30 are set smaller than distances between the upper connecting walls 86, 88 and the rollers 28 to 30. Additionally, the beaten loads received from the valve operating cams 25 and 26 disposed above the support shafts 41 to 43 are larger at the lower portions than at the upper portions of the support shafts 41 to 43. The lower portions of the support walls $\mathbf{31}_1$, $\mathbf{31}_2$, $\mathbf{32}_1$, $\mathbf{32}_2$, $\mathbf{33}_1$ and $\mathbf{33}_2$ supporting the lower portions of the support shafts 41 to 43 are reinforced by the lower connecting walls 85 and 87 protruding in the amount larger than the amount of protrusion of the upper connecting walls 86 and 88. This is convenient for increasing the rigidities of the support walls $\mathbf{31}_1$, $\mathbf{31}_2$, $\mathbf{32}_1$, $\mathbf{32}_2$, $\mathbf{33}_1$ and $\mathbf{33}_2$.

Further, in the first and second driving rocker arms 19 and 20, those faces of the tip-end connecting portions 19*b* and 20*b* which are opposed to th rollers 28 and 29 are formed into the curved shapes corresponding to the outer peripheral surfaces of the rollers 28 and 29, so that the distances between those faces and the rollers 28 and 29 become smaller at a lower location. Therefore, the oil can be also retained effectively in lower portions of the areas between the rollers 28 and 29 and the tip-end connecting portions 19*b* and 20*b*, thereby further reducing the resistance to the rotation of the rollers 28 and 29 and at the same time, increasing the thickness of the tip-end connecting portion 19*b* in a direction perpendicular to the axis of the tappet screw 27 in an area corresponding to the axially lower half of the tappet screw 27 to increase the support rigidity of the tappet screw 27.

Yet further, in the rocker arms 19 to 21, the second recess 81 faced by the lower ends of the pins 47 to 49 for fixing the support shafts 41 to 43 opens into the lower surfaces of the support wall portions $\mathbf{31}_2$, $\mathbf{32}_1$ and $\mathbf{33}_1$ at locations corresponding to the connections to the lower connecting walls 85 and 87. Therefore, it is possible to suppress reductions in rigidities of the support wall portions $\mathbf{31}_2$, $\mathbf{32}_1$ and $\mathbf{33}_1$ due to the provision of the second recess 81 to the utmost.

On the other hand, the receiving portion 62 provided on the free rocker arm 21 to abut against the lost motion mechanism 58 is disposed on the second support wall $\mathbf{33}_2$ and connected to one end of the lower connecting wall 87. Therefore, it is possible to increase the rigidity of the receiving portion 62 to which the load applied from the lost motion mechanism 58, by the lower connecting wall 87.

The notch 94 recessed on the opposite side to the spark plug insertion tube 93 is provided in t hat portion of the swinging support portion 21*a* of each of the free rocker arms 21, which Is opposed to the spark plug insertion tube 93. Therefore, the spark plug insertion tube 93 and the free rocker arm 21 can be disposed in close proximity to each other to contribute to a reduction in weight of the free rocker arm 21 and a reduction in size of the valve operating chamber defined in the internal combustion engine in such a manner to accommodate the intake-side and exhaust-side valve operating systems 17I and 17E in the engine. Moreover, at least a portion of the notch 94 (the whole in this embodiment) and at least a portion of the lower connecting wall 87 (the central portions of the lower and upper connecting walls 87 and 88) are disposed in the same plane perpendicular to the axis of the rocker shaft 22. Therefore, it is possible to compensate for the reduction in rigidity of the swinging support portion 21*a* due to the provision of the notch 94 by the lower and upper connecting walls 87 and 88.

The notch 94 is formed so that it is curved in correspondence to the outer peripheral surf ace of the spark plug insertion tube 93 which is circular in cross section, and hence, the free rocker arm 21 can be disposed in more proximity to the spark plug insertion tube 93, while avoiding the reduction in rigidity of the free rocker arm 21 to the utmost. Moreover, the radius of curvature of the notch 94 is set larger than the radius of the outer surface of the spark plug insertion tube 93 and hence, the free rocker arm 21 can be disposed in further proximity to the spark plug insertion tube 93, while avoiding the interference of the swinging free rocker arm 21 and the spark plug insertion tube 93 with each other, and it is possible to suppress the reduction in rigidity of the free rocker arm 21 due to the provision of the notch 94 to a small level.

The deepest portion of the notch 94 and a portion of the roller 30 supported on the free rocker arm 21 (preferably, the axially central portion of the roller 30 as in this embodiment) are disposed in the same plane perpendicular to the axis of the rocker shaft 22, and moreover, the notch 94 is provided in the swinging support portion 21*a* within the width of the opening 36 provided in the free rocker arm 21 to accommodate the roller 30. Therefore, the notch 94 is disposed at a location deviated from sites where a load from the intake valve VI or the exhaust valve VE and a load from the high-speed valve operating cam 26 are applied to the free rocker arm 21, and even if a reduction in rigidity of the free rocker arm 21 due to the provision of the notch 94 is generated, the sufficient rigidity of the entire free rocker arm 21 can be maintained.

The arcuate bulged portions 95, 95 bulged outwards are formed at the opposite ends of the swinging support portion 21*a* along the axis of the cam shaft 22, so that the notch 94 is sandwiched therebetween. Therefore, it is possible to compensate for the reduction in rigidity due to the notch 94 by the bulged portions 95, 95, and the rigidity of the support walls $\mathbf{33}_1$ and $\mathbf{33}_2$ to which the load from the intake valve VI or the exhaust valve VE and the load from the high-speed valve operating cam 26 are applied, can be increased by the bulged portions 95, 95.

The lubricating oil passage 76 normally leading to the oil passage 68 in the rocker shaft 22 opens into the outer surface of the swinging support portion 21*a*, but is disposed at the location deviated from the notch 94 along the axis of the rocker shaft 22. Therefore, a reduction in rigidity of the swinging support portion 21*a* cannot be produced even by the provision of the opening in the lubricating oil passage 76 and the notch 94.

Further, the oil grooves 96, 96 with their upper ends opening in the upper portion of each of the rocker arms 19, 20 and 21 are defined between the adjacent first driving rocker arm 19 and free rocker arm 21 as well as between the adjacent second driving rocker arm 20 and free rocker arm 21. Therefore, the provision of a special oil passage is not required, and sections between the rocker arms 19 and 21 as well as the arms 20 and 21 can be lubricated by a scattered oil within the valve operating chamber.

Figure 14:
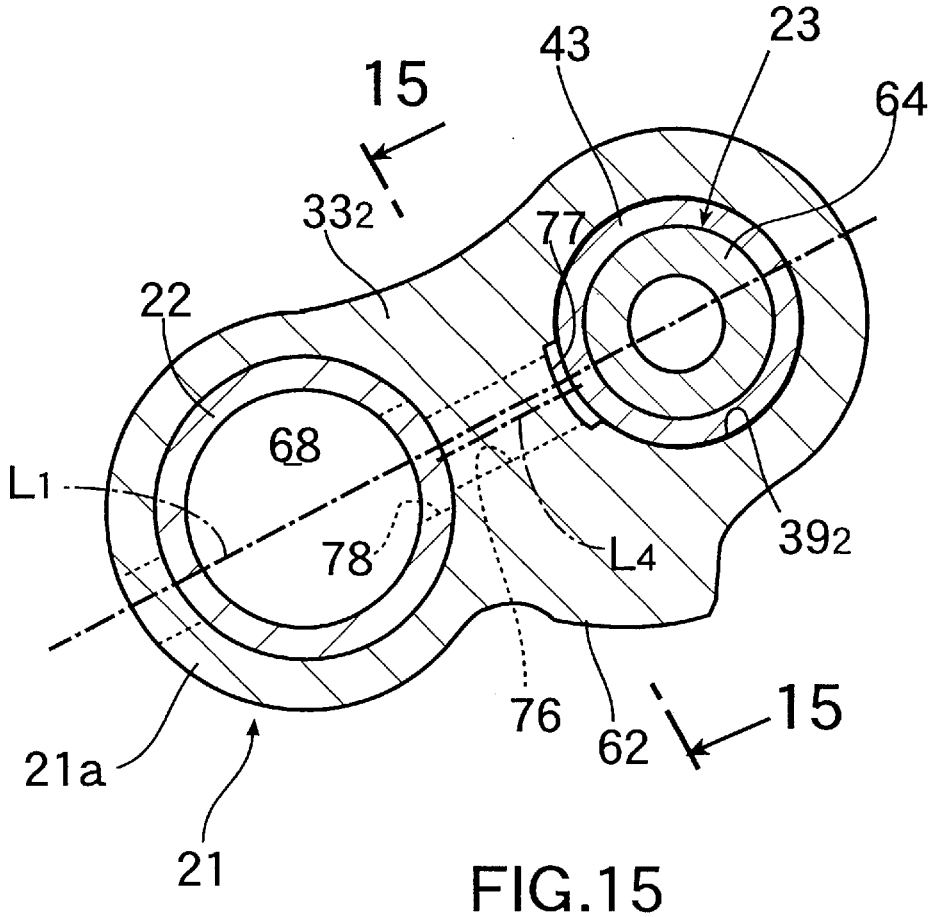
Figure 15:
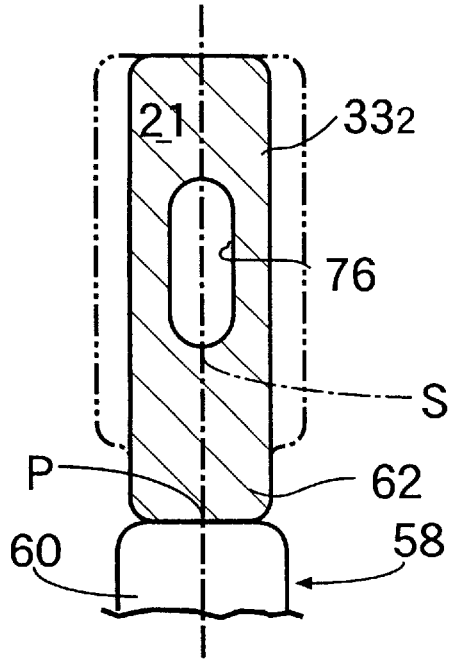

FIGS. 14 and 15 show a second embodiment of the present invention. A lubricating oil passage 76 is provided in the second support wall portion $\mathbf{33}_2$ in such a manner that a center line $L_4$ is disposed at a location displaced toward the receiving portion 62 from a straight line $L_1$ extending through the axis of the rocker shaft 22 and the axis of the support shaft 43, i.e., below the straight line $L_1$. The lubricating oil passage 76 is defined to have such a cross sectional shape that it extends long along a plane 80 which is perpendicular to the axis of the support shaft 43 and which extends through an abutment point between the receiving portion 62 and the lost motion mechanism 58.

With the second embodiment, although the width of the second support wall portion $\mathbf{33}_2$ in the first embodiment is as shown by a dashed line in FIG. 15, the width of the second support wall portion $\mathbf{33}_2$ can be decreased as shown by a solid line in FIG. 15. Moreover, even if the width of the second support wall portion $\mathbf{33}_2$ is decreased, the rigidity of the second support wall portion $\mathbf{33}_2$ cannot be reduced, because the width of the lubricating oil passage 76 is also small. Therefore, the width of the second support wall portion $\mathbf{33}_2$ can be decreased to contribute to a reduction in size of the valve operating system, while avoiding the reduction in rigidity of the second support wall portion $33_2$.

For example, the valve operating system including the rocker arms swingably supported on the rocker shaft 22 has been described in the above embodiments. The present invention is applicable to a valve operating system in which each of rocker arms is swingably supported at one end thereof by a pivot, as disclosed in Japanese Patent Application Laid-open No. 63-230916, and also widely applicable to a valve operating system in an internal combustion engine, in which each of a plurality of rocker arms 19 to 21 is operatively connected to a valve operating cam, irrespective of the presence or absence of an associative operation switching means 23 capable of switching the associative connection and the release of the associative operation of the rocker arms 19 to 21.

In addition, the present invention is applicable to a valve operating system in which pins 47 to 49 for fixing support shafts 41 to 43 are press-fitted into rocker arms 19 to 21. In this case, the connection of lower connecting walls to lower fixed portions of the pins 47 to 49 can contribute to an increase in rigidities of the rocker arms 19 to 21 receiving press-fit loads upon the press-fitting of the pins 47 to 49. Further, the support member 22 may be mounted directly on the cylinder head 11 and may be supported on a holder mounted on the cylinder head 11.

Although the embodiments of the present. invention have been described in detail, it will be understood that the present invention is not limited to the above-described embodiments, and various modifications may be made without departing from the spirit and scope of the invention defined in claims.

What is claimed is:

1. A valve operating system in an internal combustion engine, comprising a cam shaft provided with a valve operating cam, a rocker arm having a pair of support wall portions which are integrally connected at base ends thereof to a swinging support portion swingably supported on a support member mounted on a cylinder head, said support wall portions being opposed to each other at a distance in a direction along a swinging axis of said swinging support portion, a support shaft supported between said support wall portions, and a roller which is rotatably supported on said support shaft with a bearing interposed therebetween, said roller being in rolling contact with said valve operating cam, wherein said swinging support portion has a surface portion opposed to said roller and extending between said pair of support wall portions, and a lower connecting wall interconnecting lower portions of the base ends of said support wall portions is projectingly provided on said surface portion of said swinging support portion so as to be opposed to an outer peripheral surface of said roller, said lower connecting wall being closest to said outer peripheral surface of the roller in said surface portion.

2. A valve operating system according to claim 1, wherein said lower connecting wall is located in proximity to and opposed to the outer peripheral surface of said roller to such an extent that oil can be temporarily retained between said lower connecting wall and said roller.

3. A valve operating system according to claim 1, wherein said rocker arm is formed from metal by injection molding.

4. A valve operating system according to claim 2, further including an urging means for biasing said rocker arm in a direction to bring said roller into rolling contact with said valve operating cam, said urging means being put in abutment against a receiving portion which is projectingly provided at a lower portion of one of said support wall portions and connected to one end of said lower connecting wall in an axial direct ion of said support shaft.

5. A valve operating system according to claim 3, further including an urging means for biasing said rocker arm in a direction to bring said roller into rolling contact with said valve operating cam, said urging means being put in abutment against a receiving portion which is projectingly provided at a lower portion of one of said support wall portion and connected to one end of said lower connecting wall in an axial direction of said support shaft.

6. A valve operating system according to claim 1, wherein said support shaft is supported between said support wall portions with opposite ends of the support shaft being fitted in said support wall portions, at least one of said support wall portions having a receiving portion integrally provided thereon in a range corresponding to at least a portion of that area of said support shaft which is fitted into said one support wall portion, said receiving portion being disposed at a location radially outside said support shaft, and wherein an urging means is provided for exhibiting a spring force for urging said rocker arm in a direction to bring said roller, which is rotatably supported on said support shaft with the bearing interposed therebetween, into rolling contact with said valve operating cam, said urging means being put in abutment against said receiving portion.

7. A valve operating system according to claim 6, further including an oil passage which is provided in said one support wall portion to extend along a plane which extends perpendicular to the axis of said support shaft and through an abutment point between said receiving portion and said urging means.

8. A valve operating system according to claim 6, wherein said rocker arm is formed from metal by injection molding.

9. A valve operating system according to claim 7, wherein said rocker arm is formed from metal by injection molding.

10. A valve operating system according to claim 1, wherein a notch recessed on a side opposite to a spark plug insertion tube mounted in the cylinder head is provided in that portion of the swinging support portion of said rocker arm, which is opposed to said spark plug insertion tube, and at least a portion of said lower connecting wall and at least a portion of said notch are disposed in the same plane perpendicular to a swinging axis of said rocker arm.

11. A valve operating system in an internal combustion engine, comprising:

a cam shaft provided with a valve operating cam, a rocker arm having a pair of support wall portions which are integrally connected at base ends thereof to a swinging support portion swingably supported on a support member mounted on a cylinder head, said support wall portions being opposed to each other at a distance in a direction along a swinging axis of said swinging support portion, a support shaft supported between said support wall portions, a roller which is rotatably supported on said support shaft with a bearing interposed therebetween, said roller being in rolling contact with said valve operating cam, a lower connecting wall interconnecting lower portions of the base ends of said support wall portions and projecting from said swinging support portion so as to be opposed to an outer peripheral surface of a lower portion of said roller, said lower connecting wall being located in proximity to and opposed to the outer peripheral surface of the lower portion of said roller to such an extent that oil can be once retained between said lower connecting wall and said roller, and urging means for biasing said rocker arm in a direction to bring said roller into rolling contact with said valve operating cam, said urging means being put in abutment against a receiving portion which is projectingly provided at a lower portion of one of said support wall portions and connected to one end of said lower connecting wall in an axial direction of said support shaft.

12. A valve operating system in an internal combustion engine, comprising a cam shaft provided with a valve operating cam, a rocker arm being formed from metal by injection molding and having a pair of support wall portions which are integrally connected at base ends thereof to a swinging support portion swingably supported on a support member mounted on a cylinder head, said support wall portions being opposed to each other at a distance in a direction along a swinging axis of said swinging support portion, a support shaft supported between said support wall portions, a roller which is rotatably supported on said support shaft with a bearing interposed therebetween, said roller being in rolling contact with said valve operating cam, a lower connecting wall interconnecting lower portions of the base ends of said support wall portions and projecting from said swinging support portion so as to be opposed to an outer peripheral surface of a lower portion of said roller, and urging means for biasing said rocker arm in a direction to bring said roller into rolling contact with said valve operating cam, said urging means being put in abutment against a receiving portion which is projectingly provided at a lower portion of one of said support wall portions and connected to one end of said lower connecting wall in an axial direction of said support shaft.

13. A valve operating system in an internal combustion engine, comprising a cam shaft provided with a valve operating cam, a rocker arm having a pair of support wall portions which are integrally connected at base ends thereof to a swinging support portion swingably supported on a support member mounted on a cylinder head, said support wall portions being opposed to each other at a distance in a direction along a swinging axis of said swinging support portion, a support shaft supported between said support wall portions, a roller which is rotatably supported on said support shaft with a bearing interposed therebetween, said roller being in rolling contact with said valve operating cam, and a lower connecting wall interconnecting lower portions of the base ends of said support wall portions and projecting from said swinging support portion so as to be opposed to an outer peripheral surface of a lower portion of said roller, wherein said support shaft is supported between said support wall portions with opposite ends of the support shaft being fitted in said support wall portions, at least one of said support wall portions having a receiving portion integrally provided thereon in a range corresponding to at least a portion of that area of said support shaft which is fitted into said one support wall portion, said receiving portion being disposed at a location radially outside said support shaft, and wherein an urging means is provided for exhibiting a spring force for urging said rocker arm in a direction to bring said roller, which is rotatably supported on said support shaft with the bearing interposed therebetween, into rolling contact with said valve operating cam, said urging means being put in abutment against said receiving portion.

14. A valve operating system in an internal combustion engine, comprising a cam shaft provided with a valve operating cam, a rocker arm having a pair of support wall portions which are integrally connected at base ends thereof to a swinging support portion swingably supported on a support member mounted on a cylinder head, said support wall portions being opposed to each other at a distance in a direction along a swinging axis of said swinging support portion, a support shaft supported between said support wall portions, a roller which is rotatably supported on said support shaft with a bearing interposed therebetween, said roller being in rolling contact with said valve operating cam a lower connecting wall interconnecting lower portions of the base ends of said support wall portions and projecting from said swinging support portion so as to be opposed to an outer peripheral surface of a lower portion of said roller;

wherein a notch recessed on a side opposite to a spark plug insertion tube mounted in the cylinder head is provided in that portion of the swinging support portion of said rocker arm, which is opposed to said spark plug insertion tube, and at least a portion of said lower connecting wall and at least a portion of said notch are disposed in the same plane perpendicular to a swinging axis of said rocker arm.

15. A valve operating system according to claim 1, wherein said surface portion includes an upper surface portion which extends upwardly from said lower connecting wall via a recess.

16. A valve operating system according to claim 1, wherein said surface portion further includes an upper connecting wall interconnecting upper portions of the base ends of said support wall portions.

17. A valve operating system according to claim 15, wherein said surface portion further includes an upper connecting wall interconnecting upper portions of the base ends of said support wall portions, said upper connecting wall extending from said upper surface portion via a further recess.

18. A valve operating system in an internal combustion engine, comprising a cam shaft provided with a valve operating cam, a rocker arm having a pair of support wall portions which are integrally connected at base ends thereof to a swinging support portion swingably supported on a support member mounted on a cylinder head, said support wall portions being opposed to each other at a distance in a direction along a swinging axis of said swinging support portion, a support shaft supported between said support wall portions, and a roller which is rotatably supported on said support shaft with a bearing interposed therebetween, said roller being in rolling contact with said valve operating cam, wherein a lower connecting wall interconnecting lower portions of the base ends of said support wall portions is projectingly provided on said swinging support portion so as to be opposed to and spaced apart from an outer peripheral surface of a lower portion of said roller at a first distance and an upper connecting wall interconnecting upper portions of the base ends of said support wall portions is projectingly provided on said swinging support portion so as to be opposed to and spaced apart from the outer peripheral surface of an upper portion of said roller at a second distance being larger than the first distance.

* * * * *